US010360875B2

(12) United States Patent
Kang et al.

(10) Patent No.: US 10,360,875 B2
(45) Date of Patent: Jul. 23, 2019

(54) METHOD OF IMAGE PROCESSING AND DISPLAY APPARATUS PERFORMING THE SAME

(71) Applicant: Samsung Display Co., Ltd., Yongin-si, Gyeonggi-do (KR)

(72) Inventors: Bonggyun Kang, Suwon-si (KR); Nam-Gon Choi, Yongin-si (KR); Gigeun Kim, Sejong-si (KR); Jinpil Kim, Suwon-si (KR); Seunghwan Moon, Asan-si (KR); Dongwon Park, Asan-si (KR); Jaesung Bae, Suwon-si (KR); Donghwa Shin, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/586,112

(22) Filed: May 3, 2017

(65) Prior Publication Data

US 2018/0082661 A1 Mar. 22, 2018

(30) Foreign Application Priority Data

Sep. 22, 2016 (KR) ..... 10-2016-0121748

(51) Int. Cl.

| | |
|---|---|
| ***G09G 3/20*** | (2006.01) |
| ***G09G 3/36*** | (2006.01) |
| ***G09G 5/10*** | (2006.01) |

(52) U.S. Cl.

CPC ..... *G09G 5/10* (2013.01); *G09G 3/20* (2013.01); *G09G 3/36* (2013.01); *G09G 3/3611* (2013.01);

(Continued)

(58) Field of Classification Search

CPC ..... G09G 3/36; G09G 3/20; G09G 3/3611; G09G 5/10; G09G 2310/08;

(Continued)

(56) References Cited

U.S. PATENT DOCUMENTS

| | | | |
|---|---|---|---|
| 8,482,698 | B2 | 7/2013 | Atkins |
| 8,982,963 | B2 | 3/2015 | Gish et al. |

(Continued)

FOREIGN PATENT DOCUMENTS

| | | |
|---|---|---|
| JP | 2012-14627 A | 1/2012 |
| KR | 10-2013-0090904 | 8/2013 |
| KR | 10-2015-0020720 | 2/2015 |

OTHER PUBLICATIONS

EPO Extended Search Report dated Dec. 15, 2017, for corresponding European Patent Application No. 17190283.6 (10 pages).

*Primary Examiner* — Prabodh M Dharia

(74) *Attorney, Agent, or Firm* — Lewis Roca Rothgerber Christie LLP

(57) ABSTRACT

A method of image processing includes extracting first image information from an input image by analyzing the input image, determining, based on the first image information, whether to utilize a high dynamic range (HDR) function for the input image, setting an image output mode based on a result of the determination, setting a reference tone curve for the input image based on the image output mode, and generating an output image by converting the input image based on the reference tone curve.

20 Claims, 24 Drawing Sheets

(52) U.S. Cl.
CPC . *G09G 2310/08* (2013.01); *G09G 2320/0233* (2013.01); *G09G 2320/0673* (2013.01); *G09G 2320/103* (2013.01); *G09G 2360/144* (2013.01); *G09G 2360/16* (2013.01)

(58) Field of Classification Search
CPC ... G09G 2320/0233; G09G 2320/0673; G09G 2360/144
USPC ..... 345/690–692; 348/223.1, 234, 222.1, 348/231.99, 254, 673; 382/169, 274, 284
See application file for complete search history.

(56) References Cited

U.S. PATENT DOCUMENTS

2002/0036696 A1* 3/2002 Takemoto ..... H04N 1/60 348/211.6
2006/0061842 A1 3/2006 Oka et al.
2008/0252791 A1* 10/2008 Mitsunaga ..... H04N 5/20 348/673
2010/0007665 A1* 1/2010 Smith ..... G06T 13/40 345/473
2010/0195906 A1* 8/2010 Uliyar ..... G06T 5/008 382/167
2010/0232685 A1* 9/2010 Yokokawa ..... H04N 5/142 382/159
2011/0193895 A1* 8/2011 Johnson ..... G09G 3/3426 345/690
2011/0228295 A1* 9/2011 Doida ..... G06T 5/50 358/1.9
2011/0235945 A1* 9/2011 Wakazono ..... H04N 5/217 382/300
2012/0154454 A1* 6/2012 Ohishi ..... G09G 3/342 345/690
2013/0293596 A1 11/2013 Atkins
2015/0016735 A1* 1/2015 Kikuchi ..... G06T 9/00 382/232
2015/0022638 A1* 1/2015 Saeki ..... G06T 7/0004 348/46
2015/0042833 A1* 2/2015 Lelescu ..... G06T 3/4076 348/218.1
2015/0201109 A1* 7/2015 Li ..... H04N 1/4074 348/222.1
2015/0208046 A1* 7/2015 Kawaguchi ..... H04N 9/69 348/234
2015/0243200 A1 8/2015 Pan
2015/0350515 A1* 12/2015 Demandolx ..... H04N 5/2354 348/223.1
2015/0355443 A1 12/2015 Okabe
2015/0358646 A1* 12/2015 Mertens ..... H04N 1/6058 382/166
2015/0371426 A1* 12/2015 Levy ..... G06T 13/80 345/473
2016/0110855 A1 4/2016 Hirayama
2016/0165120 A1* 6/2016 Lim ..... H04N 5/2355 348/148
2016/0342398 A1* 11/2016 Yelsey ..... G06N 5/02
2017/0061591 A1* 3/2017 Park ..... G09G 3/2092
2017/0083767 A1* 3/2017 Qian ..... G06K 9/00624
2017/0256039 A1* 9/2017 Hsu ..... G06T 5/009
2017/0318243 A1* 11/2017 Ise ..... H04N 5/243
2018/0103258 A1* 4/2018 Chen ..... H04N 19/46
2019/0014257 A1* 1/2019 Yoshikawa ..... H04N 5/23216

* cited by examiner

METHOD OF IMAGE PROCESSING AND DISPLAY APPARATUS PERFORMING THE SAME

CROSS-REFERENCE TO RELATED APPLICATION

This application claims priority to and the benefit of Korean Patent Application No. 10-2016-0121748, filed on Sep. 22, 2016 in the Korean Intellectual Property Office (KIPO), the content of which is herein incorporated by reference in its entirety.

BACKGROUND

1. Field

Aspects of embodiments of the present disclosure relate generally to displaying images, and more particularly to methods of image processing and display apparatuses performing the methods.

2. Description of the Related Art

A liquid crystal display apparatus is a type (or kind) of flat panel display (FPD), which has been widely used in recent years. The FPDs may include, for example, liquid crystal displays (LCDs), plasma display panels (PDPs), and organic light emitting displays (OLEDs).

Images displayed on a display apparatus may have various luminance ranges. The luminance range may represent a range between the largest and smallest luminances, and the luminance range of an image or a scene being photographed or captured may be referred to as a dynamic range. There are increasing demands for a high dynamic range (HDR) function in which a reproduced image is displayed to make a user feel as if he or she is seeing a real scene.

SUMMARY

Accordingly, some embodiments of the present disclosure are provided to substantially obviate one or more problems due to limitations and disadvantages of the related art.

Aspects of some embodiments of the present disclosure are directed to a method of image processing capable of efficiently displaying a high dynamic range (HDR) image.

Aspects of some embodiments of the present disclosure are directed to a display apparatus performing said method.

According to some embodiments of the present disclosure, there is provided a method of image processing, the method including: extracting first image information from an input image by analyzing the input image; determining, based on the first image information, whether to utilize a high dynamic range (HDR) function for the input image; setting an image output mode based on a result of the determination; setting a reference tone curve for the input image based on the image output mode; and generating an output image by converting the input image based on the reference tone curve.

In an embodiment, the extracting of the first image information includes: obtaining color space information from the input image; obtaining a first peak luminance, a second peak luminance, and an average luminance from the input image; and obtaining a first value corresponding to the first peak luminance in the input image, a second value corresponding to the second peak luminance in the input image, and a third value corresponding to the average luminance in the input image.

In an embodiment, the determining of whether to utilize the HDR function for the input image includes: determining whether a difference between the first and second peak luminances is greater than a reference luminance; determining whether each of a difference between the first and third values and a difference between the second and third values is greater than a first reference value; and determining whether the third value is less than a second reference value.

In an embodiment, it is determined to utilize the HDR function for the input image when the difference between the first and second peak luminances is greater than the reference luminance, when both the difference between the first and third values and the difference between the second and third values are greater than the first reference value, and when the third value is less than the second reference value.

In an embodiment, the setting of the image output mode includes: setting the image output mode to a first standard dynamic range (SDR) output mode when it is determined not to utilize the HDR function for the input image; and setting the image output mode to a first HDR output mode when it is determined to utilize the HDR function for the input image.

In an embodiment, the method further includes: selectively receiving second image information associated with the input image, wherein setting the image output mode further includes: setting the image output mode to a second SDR output mode when the second image information is received, and when it is determined not to utilize the HDR function for the input image; and setting the image output mode to a second HDR output mode when the second image information is received, and when it is determined to utilize the HDR function for the input image.

In an embodiment, the setting of the reference tone curve includes: generating a cumulative luminance histogram by accumulating an input luminance histogram of the input image; determining a reference tone curve parameter based on the first image information; and generating the reference tone curve by adjusting the cumulative luminance histogram based on the reference tone curve parameter.

In an embodiment, the extracting of the first image information includes: determining whether an image type of the input image corresponds to a static image or a dynamic image; obtaining, by an illuminance sensor, illuminance of display circumstances in which the output image is to be displayed; and obtaining a luminance range of a backlight circuit in a display panel on which the output image is to be displayed, wherein the reference tone curve parameter is determined based on at least one of the image type of the input image, the illuminance of the display circumstances, and the luminance range of the backlight circuit.

In an embodiment, the generating of the output image includes: generating an output luminance histogram of the output image by mapping an input luminance histogram of the input image based on the reference tone curve.

In an embodiment, the output luminance histogram is generated by performing an inverse tone mapping on the input luminance histogram when it is determined to utilize the HDR function for the input image.

In an embodiment, the method further includes: performing a temporal filtering on the output image.

In an embodiment, the performing of the temporal filtering includes: inserting at least one buffer frame image between a current frame image and a previous frame image, the current frame image corresponding to the output image, the previous frame image corresponding to an image being processed prior to the output image.

In an embodiment, a measured tone curve of the output image is matched to the reference tone curve after the output image is generated by applying the HDR function to the input image, the measured tone curve being obtained by measuring luminance of the output image displayed on a display panel.

According to some embodiments of the present disclosure, there is provided a display apparatus including: a timing controller configured to extract first image information from an input image by analyzing the input image, to determine, based on the first image information, whether to utilize a high dynamic range (HDR) function for the input image, to set an image output mode based on a result of the determination, to set a reference tone curve for the input image based on the image output mode, and to generate an output image by converting the input image based on the reference tone curve; and a display panel configured to display the output image.

In an embodiment, the timing controller is configured to: obtain color space information from the input image, obtain a first peak luminance, a second peak luminance, and an average luminance from the input image, obtain a first value corresponding to the first peak luminance in the input image, a second value corresponding to the second peak luminance in the input image, and a third value corresponding to the average luminance in the input image, and determine to utilize the HDR function for the input image when a difference between the first and second peak luminances is greater than a reference luminance, when both a difference between the first and third values and a difference between the second and third values are greater than a first reference value, and when the third value is less than a second reference value.

In an embodiment, the timing controller is configured to: set the image output mode to a first standard dynamic range (SDR) output mode when it is determined not to utilize the HDR function for the input image, and set the image output mode to a first HDR output mode when it is determined to utilize the HDR function for the input image.

In an embodiment, the timing controller is configured to: generate a cumulative luminance histogram by accumulating an input luminance histogram of the input image, determine a reference tone curve parameter based on the first image information, and generate the reference tone curve by adjusting the cumulative luminance histogram based on the reference tone curve parameter.

In an embodiment, the timing controller is configured to generate an output luminance histogram of the output image by mapping an input luminance histogram of the input image based on the reference tone curve, and the timing controller is configured to generate the output luminance histogram by further performing an inverse tone mapping on the input luminance histogram when it is determined to utilize the HDR function for the input image.

In an embodiment, the timing controller is configured to further perform a temporal filtering on the output image by inserting at least one buffer frame image between a current frame image and a previous frame image, and the current frame image corresponds to the output image, and the previous frame image corresponds to an image being processed prior to the output image.

In an embodiment, the timing controller is configured to match a measured tone curve of the output image to the reference tone curve after the output image is generated by applying the HDR function to the input image, the measured tone curve being obtained by measuring luminance of the output image displayed on the display panel.

Thus, it may be determined whether the HDR function is desired for a particular input image by automatically analyzing the input image without receiving HDR image information from an image provider. An optimized HDR image may be generated actively and in real time by performing an optimized image processing for a current image and current circumstances based on various information representing results of the image analysis. Accordingly, the HDR image that has a relatively high contrast and is closely representative of a real scene may be displayed without complex HDR encoding/decoding processes, and thus the image processing performance and the display quality may be improved.

BRIEF DESCRIPTION OF THE DRAWINGS

Illustrative, non-limiting exemplary embodiments will be more clearly understood from the following detailed description taken in conjunction with the accompanying drawings.

DETAILED DESCRIPTION

Figure 1:
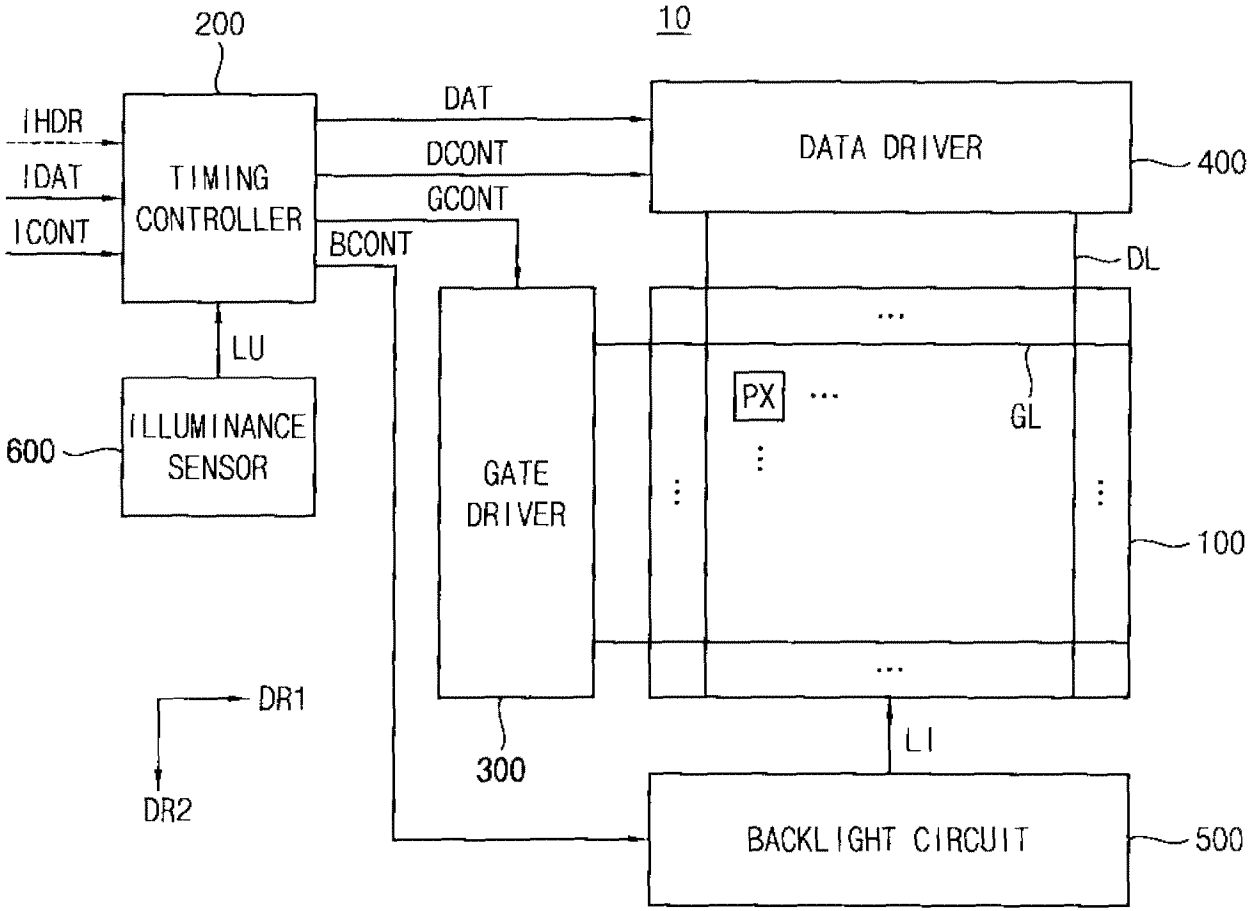
FIG. 1 is a block diagram illustrating a display apparatus according to some exemplary embodiments of the present disclosure.

Various exemplary embodiments will be described more fully with reference to the accompanying drawings, in which embodiments are shown. This inventive concept may, however, be embodied in many different forms and should not be construed as limited to the embodiments set forth herein. Like reference numerals refer to like elements throughout this application.

FIG. 1 is a block diagram illustrating a display apparatus according to exemplary embodiments of the present disclosure.

Referring to FIG. 1, a display apparatus 10 includes a display panel 100, a timing controller 200, a gate driver 300, a data driver 400, a backlight circuit 500, and an illuminance sensor 600.

The display panel 100 is connected to a plurality of gate lines GL and a plurality of data lines DL. The gate lines GL may extend in a first direction DR1, and the data lines DL may extend in a second direction DR2 crossing (e.g., substantially perpendicular to) the first direction DR1. The display panel 100 may include a plurality of pixels PX that are arranged in a matrix form. Each of the pixels PX may be electrically connected to a respective one of the gate lines GL and a respective one of the data lines DL.

The timing controller 200 controls operations of the display panel 100, the gate driver 300, the data driver 400, and the backlight circuit 500. The timing controller 200 receives input image data IDAT and an input control signal ICONT from an external device (e.g., a host or a graphic processor). The timing controller 200 may selectively receive image information IHDR from the external device. The input image data IDAT may include a plurality of pixel data for the plurality of pixels PX. The input control signal ICONT may include a master clock signal, a data enable signal, a vertical synchronization signal, a horizontal synchronization signal, and/or the like. The image information IHDR may include high dynamic range (HDR) meta data, and may be provided from an image provider only when an input image corresponding to the input image data IDAT is an HDR image.

The HDR image may indicate an image to which an HDR function is applied. In contrast, an image to which the HDR function is not applied may be referred to as a standard dynamic range (SDR) image or a low dynamic range (LDR) image. The HDR image may represent a relatively wide luminance range that may approximate a real scene. In contrast, the SDR or LDR image may represent a relatively narrow luminance range.

The timing controller 200 generates output image data DAT based on the input image data IDAT. According to exemplary embodiments, the image information IHDR, illuminance LU of display circumstances, and/or the like may be further used (utilized) for generating the output image data DAT. The timing controller 200 generates a first control signal GCONT, a second control signal DCONT, and a third control signal BCONT based on the input control signal ICONT. For example, the first control signal GCONT may include a vertical start signal, a gate clock signal, and/or the like. The second control signal DCONT may include a horizontal start signal, a data clock signal, a polarity control signal, a data load signal, and/or the like. The third control signal BCONT may include a pulse width modulation (PWM) signal, and/or the like.

The gate driver 300 is connected to the display panel 100 by the gate lines GL, and generates a plurality of gate signals for driving the display panel 100 based on the first control signal GCONT. For example, the gate driver 300 may sequentially provide the gate signals to the display panel 100 through the gate lines GL.

The data driver 400 is connected to the display panel 100 by the data lines DL, and generates a plurality of data voltages (e.g., analog voltages) for driving the display panel 100 based on the output image data DAT (e.g., digital data) and the second control signal DCONT. For example, the data driver 400 may sequentially provide the data voltages to a plurality of lines (e.g., horizontal lines) in the display panel 100 through the data lines DL.

The backlight circuit 500 provides light LI to the display panel 100 based on the third control signal BCONT. For example, the backlight circuit 500 may include a plurality of light sources, for example, light emitting diodes (LEDs). The backlight circuit 500 may operate based on a global dimming scheme and/or a local dimming scheme.

The illuminance sensor 600 measures the illuminance LU of the display circumstances. For example, the illuminance LU of the display circumstances may indicate illuminance at a place where the display apparatus 10 is set up or installed. When a target image is to be displayed on the display panel 100 based on the output image data DAT, the illuminance LU of the display circumstances may indicate illuminance of environment surrounding the display apparatus 10.

In some exemplary embodiments, the gate driver 300 and/or the data driver 400 may be disposed, for example, directly mounted, on the display panel 100, or may be connected to the display panel 100 via a tape carrier package (TCP) type (or kind) part. In some examples, the gate driver 300 and/or the data driver 400 may be integrated on the display panel 100.

Figure 2:
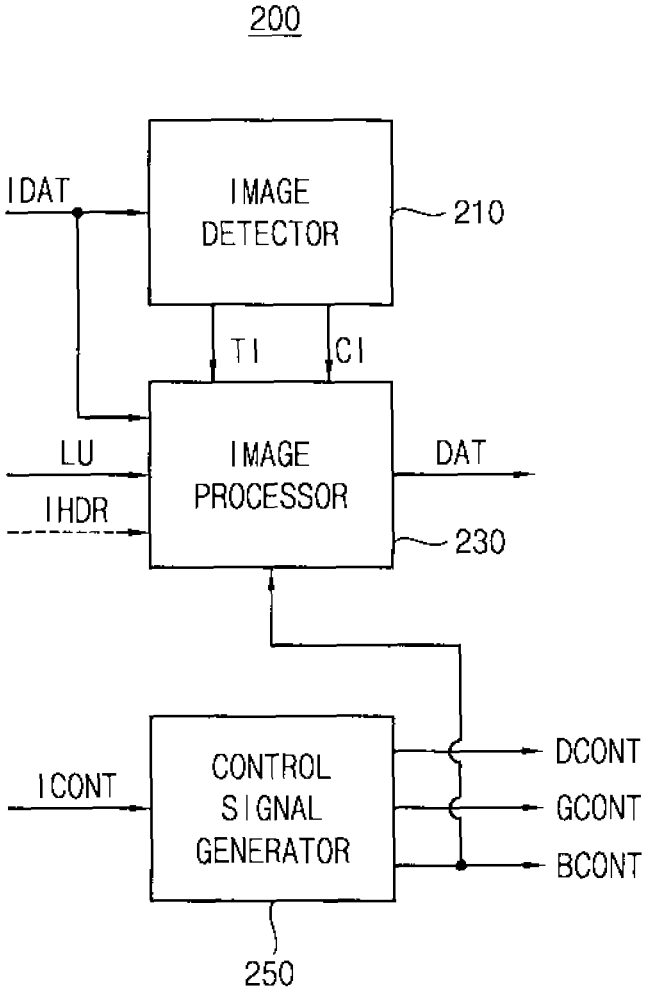
FIG. 2 is a block diagram illustrating a timing controller included in a display apparatus according to some exemplary embodiments of the present disclosure.

FIG. 2 is a block diagram illustrating a timing controller included in a display apparatus according to exemplary embodiments of the present disclosure.

Referring to FIGS. 1 and 2, the timing controller 200 may include an image detector 210, an image processor 230 and a control signal generator 250.

The image detector 210 may obtain image type (or kind) information TI and color information CI based on the input image data IDAT.

The image type (or kind) information TI may indicate whether an input image corresponding to the input image data IDAT is a static image (e.g., a still image, a stopped image, a photograph, or the like) or a dynamic image (e.g., a moving image, a video, or the like). For example, if it is assumed that the input image is a current frame image, the image detector 210 may compare the current frame image with a previous frame image to determine whether the input image is the static image or the dynamic image. In some examples, a flag signal that is substantially the same as the image type (or kind) information TI may be provided from the external device.

The color information CI may include color space information of the input image. For example, the color space information may be one of various color space information, for example, HSV (hue, saturation and value) color space information, HSL (hue, saturation and lightness) color space information, RGB (red, green, and blue) color space information, CMYK (cyan, magenta, yellow, and key) color space information, or the like.

The image processor 230 may obtain luminance information based on the input image data IDAT. The image processor 230 may generate the output image data DAT by processing (e.g., converting, modifying, or transforming) the input image data IDAT based on at least one of the color information CI, the luminance information, the image type (or kind) information TI, the illuminance LU of the display circumstances, the third control signal BCONT and the image information IHDR. An output image may be displayed on the display panel 100 based on the output image data DAT.

In some exemplary embodiments, the image processor 230 may perform various operations for selectively applying or employing the HDR function to the input image. The image processor 230 may include an image analyzing unit (e.g., image analyzer), a determining unit (e.g., a determiner), a mode setting unit (e.g., a mode setter), a tone curve setting unit (e.g., a tone curve setter), a converting unit (e.g., a converter), a storage unit (e.g., a storage), a temporal filtering unit (e.g., a temporal filter), and/or the like. The operations, by the image detector 210 and the image processor 230, for generating the output image data DAT will be described in further detail.

The control signal generator 250 may generate the first control signal GCONT, the second control signal DCONT and the third control signal BCONT based on the input control signal ICONT.

The timing controller 200 may further include a processor (e.g., a micro controller unit (MCU)) that controls overall operations of elements in the timing controller 200, and/or an additional processing block that selectively performs an image quality compensation, a spot compensation, an adaptive color correction (ACC), a dynamic capacitance compensation (DCC), and/or the like, on the input image data IDAT.

Figure 3:
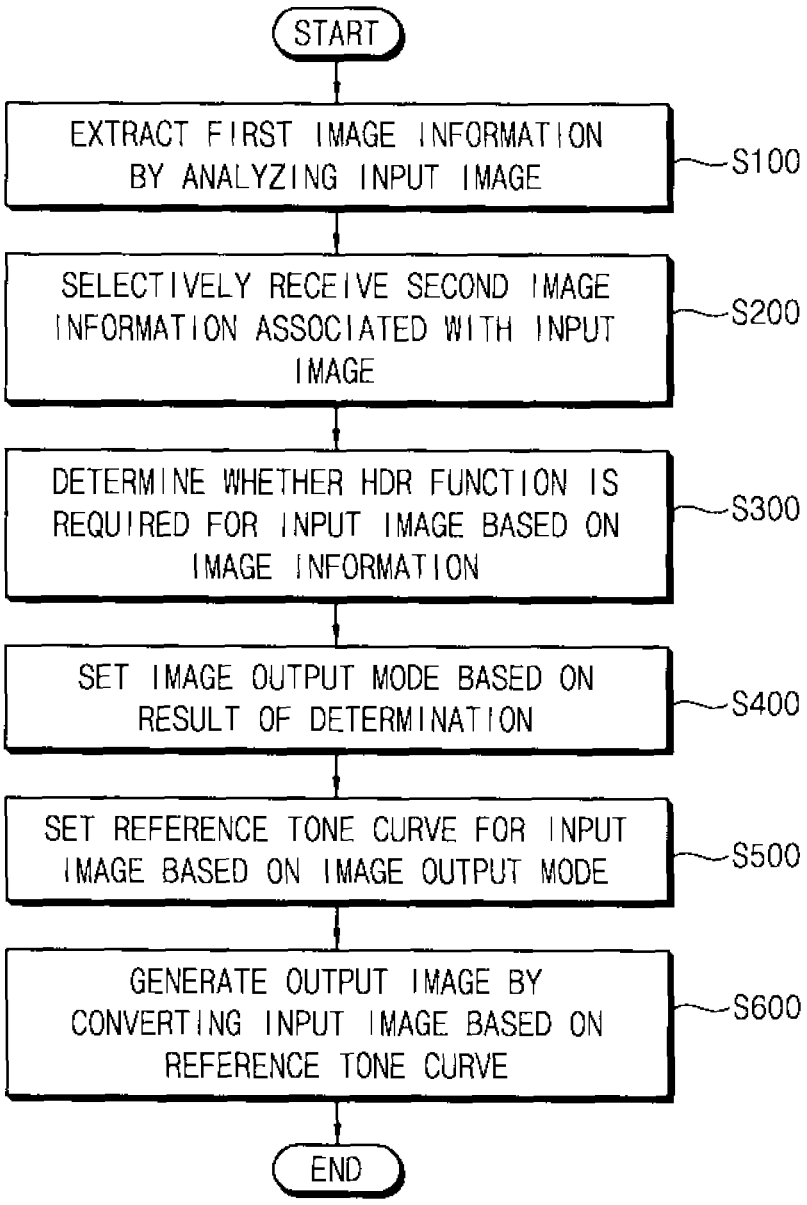
FIG. 3 is a flow diagram illustrating a method of image processing according to some exemplary embodiments of the present disclosure.

FIG. 3 is a flow diagram illustrating a method of image processing according to exemplary embodiments of the present disclosure.

Referring to FIGS. 1, 2 and 3, in a method of image processing according to exemplary embodiments, first image information is extracted from an input image by analyzing the input image (act S100). The first image information may not be provided from the external device, and may indicate information that is obtained by internally, directly or autonomously analyzing the input image. For example, the first image information may include the color information CI, the luminance information, the image type (or kind) information TI, the illuminance LU of the display circumstances, a luminance range of the backlight circuit 500, and/or the like.

Second image information associated with the input image may be selectively received (act S200). The second image information may not be obtained by analyzing the input image, and may indicate information that is provided from the external device. For example, the second image information may include the image information IHDR. In some examples, act S200 may be omitted (e.g., not performed).

As described above with reference to FIG. 1, the image information IHDR may be provided from the image provider only when the input image is an HDR image. In other words, the input image is the HDR image when the second image information is received, and the input image is an SDR image when the second image information is not received.

It is determined whether to utilize the HDR function for the input image based on the image information (act S300). For example, based on the first image information, or based on the first and second image information, it may be determined whether the input image is suitable or appropriate for the HDR function.

An image output mode is set based on a result of the determination (act S400). The image output mode may include an SDR output mode in which the HDR function is not utilized for the input image, and an HDR output mode in which the HDR function is utilized for the input image. Based on whether the second image information is received, the SDR output mode may be divided into a first SDR output mode and a second SDR output mode, and the HDR output mode may be divided into a first HDR output mode and a second HDR output mode.

A reference tone curve that is suitable for the input image is set based on the image output mode (act S500). A tone curve may be a graph that indicates a relationship between input luminance of an original image and output luminance of a converted image. In other words, the tone curve may indicate a relationship between input grayscale values of the input image and output grayscale values of the output image. As will be described with reference to FIGS. 8C, 9C, 10C and 11C, the reference tone curve may have a linear shape, an S shape, an inverse S shape, or the like depending on the image output mode.

An output image is generated by converting the input image based on the reference tone curve (act S600). Similar to the input image, the output image may be one of the HDR image and the SDR image. The output image may be substantially the same as or different from the input image depending on the image output mode.

The output image may be displayed on the display panel 100 after act S600.

Figure 4:
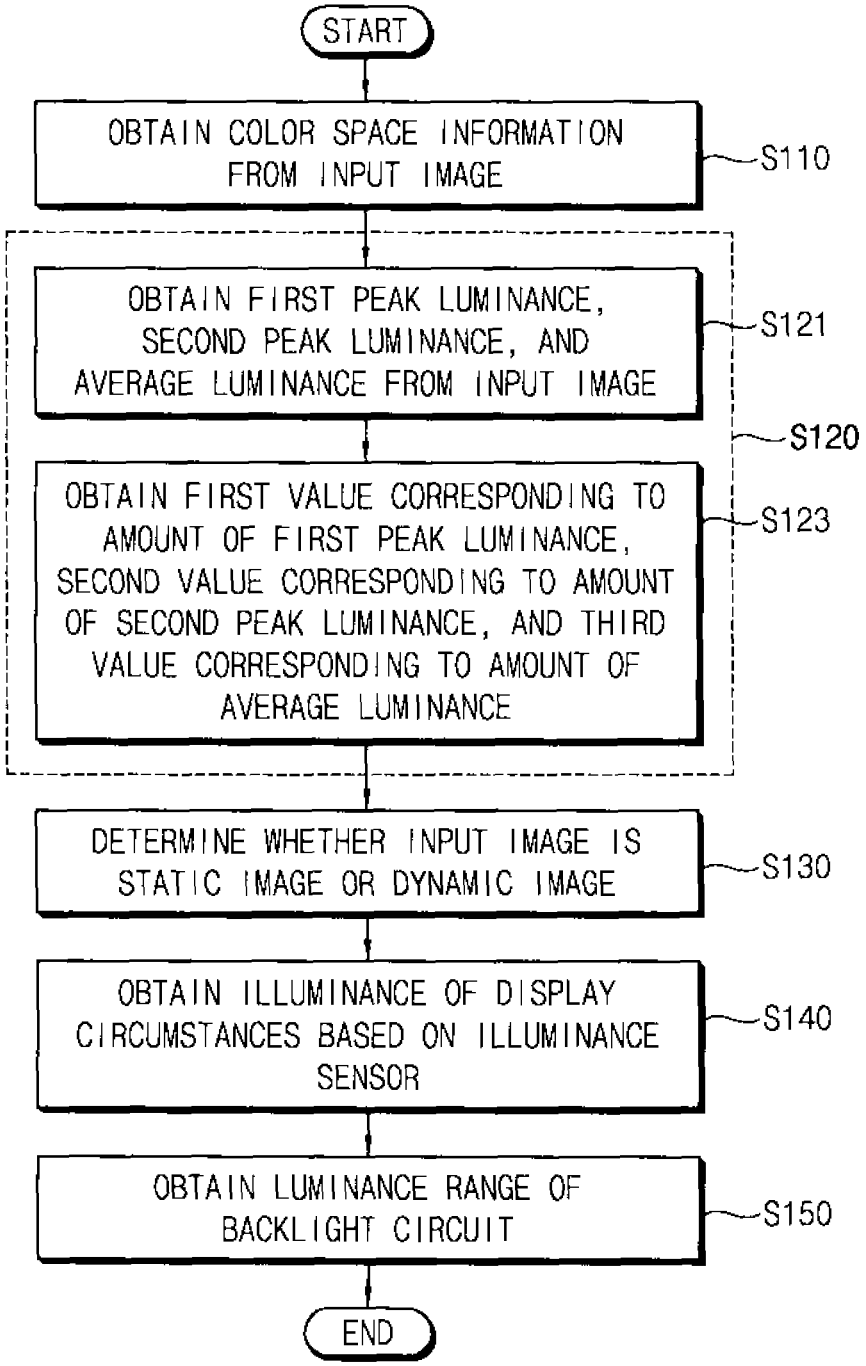
FIG. 4 is a flow diagram illustrating an example of extracting first image information in FIG. 3.

FIG. 4 is a flow diagram illustrating an example of extracting first image information in FIG. 3.

Referring to FIGS. 1, 2, 3 and 4, in act S100, color space information may be obtained from the input image by analyzing the input image data IDAT (act S110). The color space information may be included in the color information CI, and may include HSV color space information, HSL color space information, RGB color space information, CMYK color space information, or the like. For example, the color space information may be obtained by analyzing an input color histogram of the input image.

The luminance information may be obtained from the input image by analyzing an input luminance histogram of the input image based on the input image data IDAT (act S120). For example, a first peak luminance, a second peak luminance and an average luminance may be obtained from the input image (act S121). In addition, a first value corresponding to the first peak luminance in the input image, a second value corresponding to the second peak luminance in the input image, and a third value corresponding to the average luminance in the input image may be obtained (act S123). In other words, coordinates of the first peak luminance, the second peak luminance and the average luminance in the input luminance histogram may be obtained in act S120. For example, the input luminance histogram may indicate a luminance histogram associated with a dominant color in the input image.

In some exemplary embodiments, the first value may be substantially the same as the number of pixels having the first peak luminance in the input image. Similarly, the second value may be substantially the same as the number of pixels having the second peak luminance in the input image, and the third value may be substantially the same as the number of pixels having the average luminance in the input image.

It may be determined whether an image type (or kind) of the input image corresponds to a static image or a dynamic image (act S130). For example, a current frame image corresponding to the input image may be compared with a previous frame image. It may be determined that the input image is the static image when the current frame image is substantially the same as the previous frame image. It may be determined that the input image is the dynamic image when the current frame image is different from the previous frame image. The image type (or kind) of the input image may be included in the image type (or kind) information TI.

The illuminance LU of the display circumstances in which the output image is to be displayed may be obtained based on the illuminance sensor 600 (act S140). The luminance range of the backlight circuit 500 may be obtained based on the third control signal BCONT (act S150). Additional information for the method according to exemplary embodiments (e.g., color temperature information of the display circumstances, or the like) may be further obtained.

In some exemplary embodiments, acts S110 and S130 may be performed by the image detector 210, and acts S120 and S150 may be performed by the image processor 230. For example, the image processor 230 may include an image analyzing unit (e.g., an image analyzer) for performing acts S120 and S150.

Some of the first image information may be used in act S300, and the other of the first image information may be used in act S500. For example, the color space information and the luminance information may be used for determining whether to utilize the HDR function for the input image. The image type (or kind) of the input image, the illuminance LU of the display circumstances and the luminance range of the backlight circuit 500 may be used for setting the reference tone curve.

Figure 5:
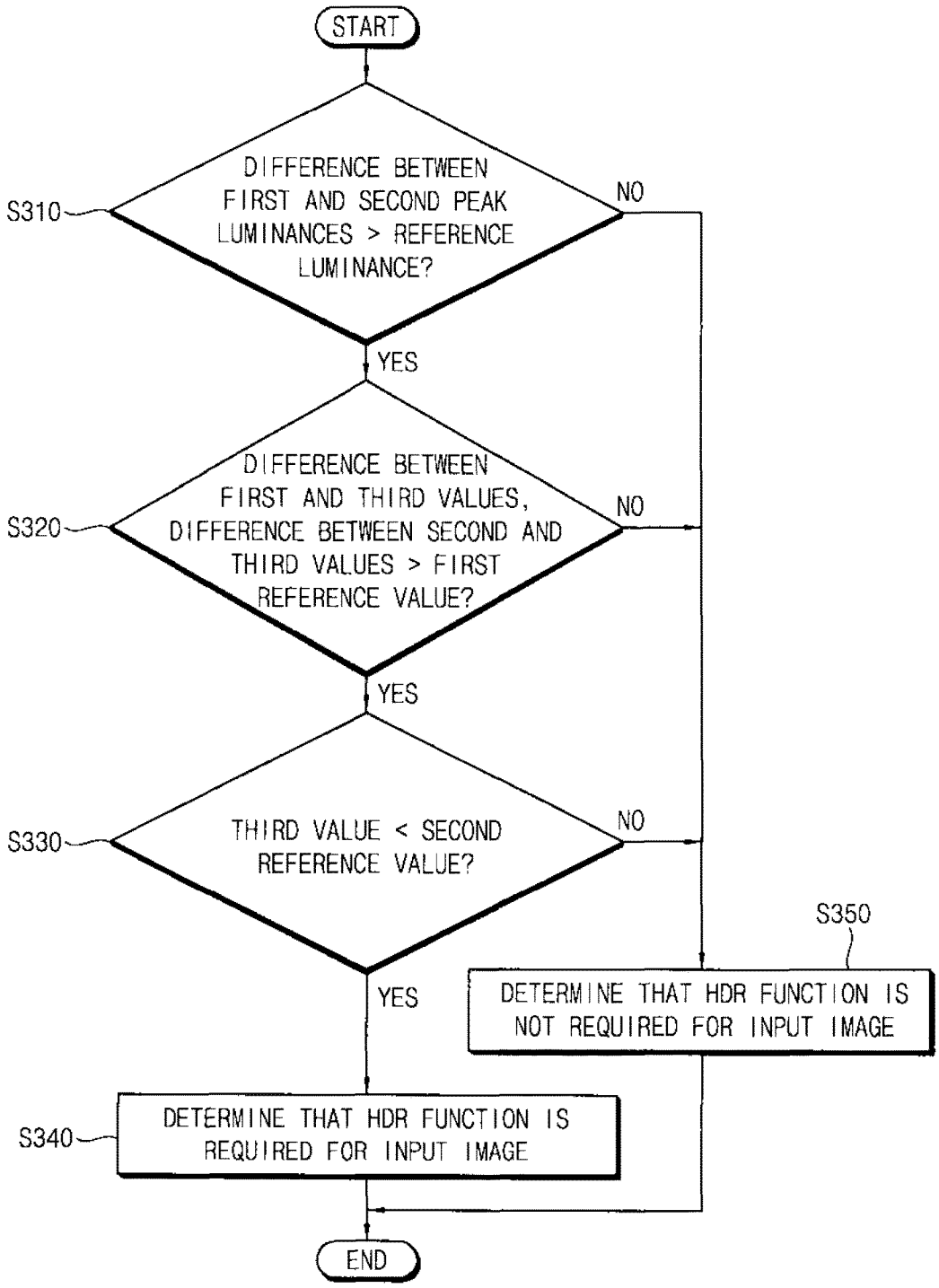
FIG. 5 is a flow diagram illustrating an example of determining whether an HDR function is required for an input image in FIG. 3.

FIG. 5 is a flow diagram illustrating an example of a process of determining whether to utilize an HDR function for an input image in FIG. 3. FIGS. 6A, 6B, 6C and 6D are diagrams for describing an operation of FIG. 5. FIGS. 6A, 6B, 6C and 6D illustrate examples of an input luminance histogram. In FIGS. 6A, 6B, 6C and 6D, the horizontal axis indicates luminance L, and the vertical axis indicates the number of pixels N.

Referring to FIGS. 3, 5, 6A, 6B, 6C and 6D, in act S300, the luminance information of the input image that is obtained by act S120 in FIG. 4 may be used for act S300.

It may be determined whether a difference between the first and second peak luminances is greater than a reference luminance (act S310). It may be determined whether each of a difference between the first and third values and a difference between the second and third values is greater than a first reference value (act S320). It may be determined whether the third value is less than a second reference value (act S330). Based on the result of the determination (e.g., based on results of acts S310, S320 and S330), it may be determined to utiilize the HDR function for the input image (act S340), or it may be determined not to utilize the HDR function for the input image (act S350).

Figure 6A:
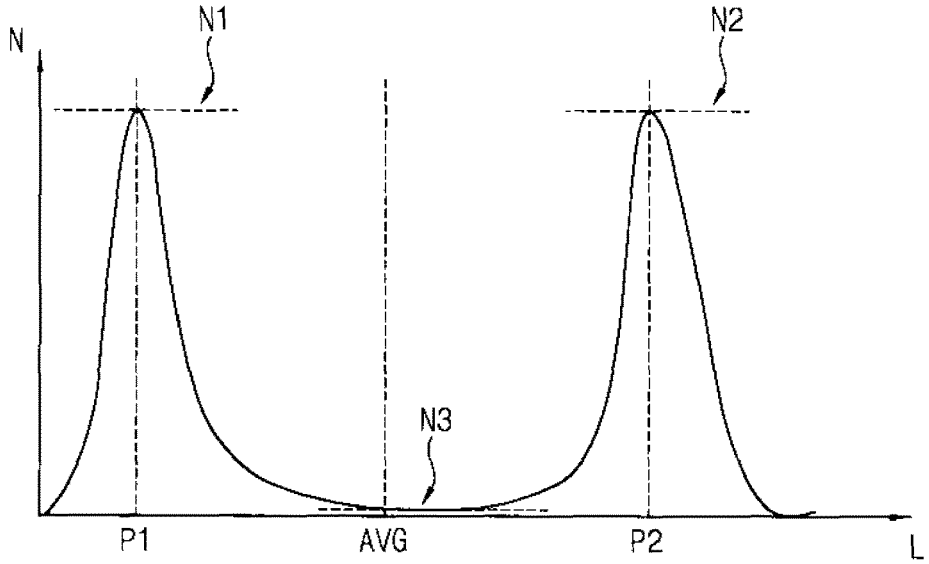
FIGS. 6A-6D are diagrams for describing an operation of FIG. 5.

In some exemplary embodiments, an input luminance histogram of the input image may be obtained as illustrated in FIG. 6A. In an example of FIG. 6A, a difference between first and second peak luminances P1 and P2 may be greater than the reference luminance (act S310: YES), both a difference between first and third values N1 and N3 and a difference between second and third values N2 and N3 may be greater than the first reference value (act S320: YES), the third value N3 may be less than the second reference value (act S330: YES), and thus it may be determined to utilize the HDR function for the input image (act S340). In other words, in the example of FIG. 6A, the first and second peak luminances P1 and P2 may be sufficiently spaced apart from each other, the values N1 and N2 of the peak luminances P1 and P2 may be sufficiently large values, the value N3 of an average luminance AVG may be sufficiently small value, and thus it may be determined that the input image is suitable or appropriate for the HDR function.

Figure 6B:
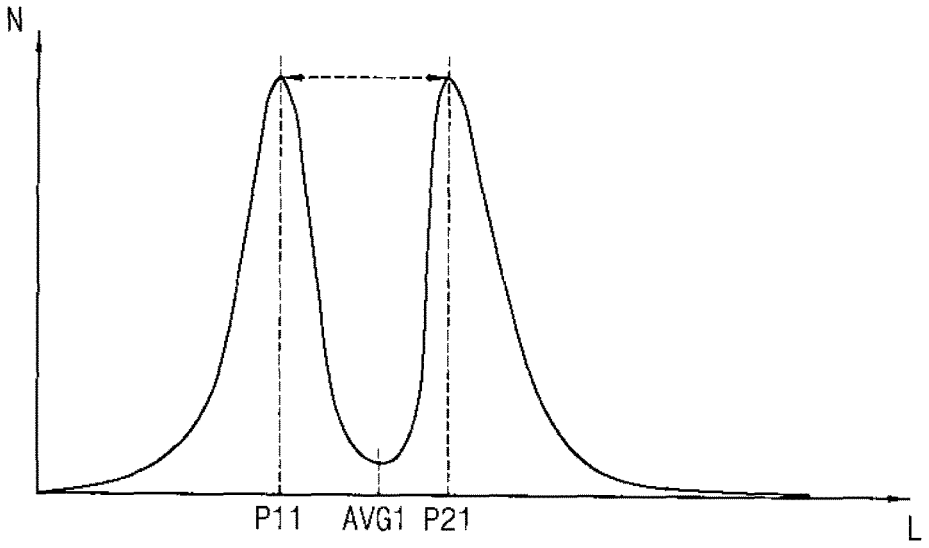

In other exemplary embodiments, an input luminance histogram of the input image may be obtained as illustrated in FIG. 6B. In an example of FIG. 6B, a difference between first and second peak luminances P11 and P21 may be less than the reference luminance (act S310: NO), and thus it may be determined not to utilize the HDR function for the input image (act S350). In other words, in the example of FIG. 6B, the first and second peak luminances P11 and P21 may not be sufficiently spaced apart from each other, and thus it may be determined that the input image is not suitable or appropriate for the HDR function regardless of an average luminance AVG1.

Figure 6C:
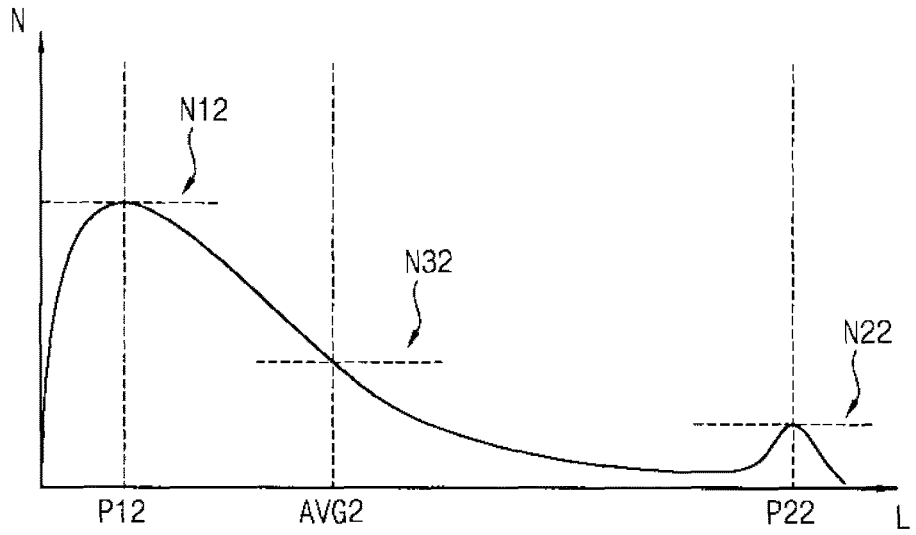

In still other exemplary embodiments, an input luminance histogram of the input image may be obtained as illustrated in FIG. 6C. In an example of FIG. 6C, a difference between first and second peak luminances P12 and P22 may be greater than the reference luminance (act S310: YES), a difference between first and third values N12 and N32 may be greater than the first reference value, however, a difference between second and third values N22 and N32 may be less than the first reference value (act S320: NO), and thus it may be determined not to utliize the HDR function for the input image (act S350). In other words, in the example of FIG. 6C, the value N22 of the peak luminance P22 may not be sufficiently large value, and the value N32 of an average luminance AVG2 may not be sufficiently small value, and thus it may be determined that the input image is not suitable or appropriate for the HDR function.

Figure 6D:
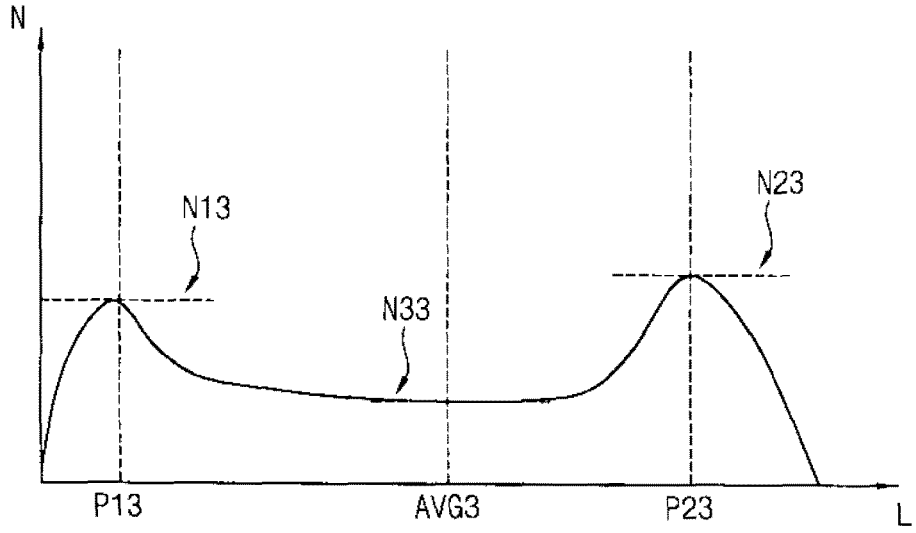

In still other exemplary embodiments, an input luminance histogram of the input image may be obtained as illustrated in FIG. 6D. In an example of FIG. 6D, a difference between first and second peak luminances P13 and P23 may be greater than the reference luminance (act S310: YES), both a difference between first and third values N13 and N33 and a difference between second and third values N23 and N33 may be greater than the first reference value (act S320: YES), however, the third value N33 may be greater than the second reference value (act S330: NO), and thus it may be determined not to utilize the HDR function for the input image (act S350). In other words, in the example of FIG. 6D, the value N33 of an average luminance AVG3 may not be sufficiently small value, and thus it may be determined that the input image is not suitable or appropriate for the HDR function.

In some exemplary embodiments, acts S310 through S350 may be performed by the image processor 230. For example, the image processor 230 may include a determining unit (e.g., a determiner) for performing acts S310 through S350.

Although example criteria and/or schemes for determining whether to utilize the HDR function for the input image are described with reference to FIGS. 5, 6A, 6B, 6C and 6D, various determining criteria and/or schemes may exist. For example, it may be determined whether to utilize the HDR function for the input image by totally and/or partially comparing various factors such as maximum/minimum distribution for each grayscale, grayscale deviation, maximum/minimum luminances, contrast of average/low/high luminances, or the like.

Figure 7:
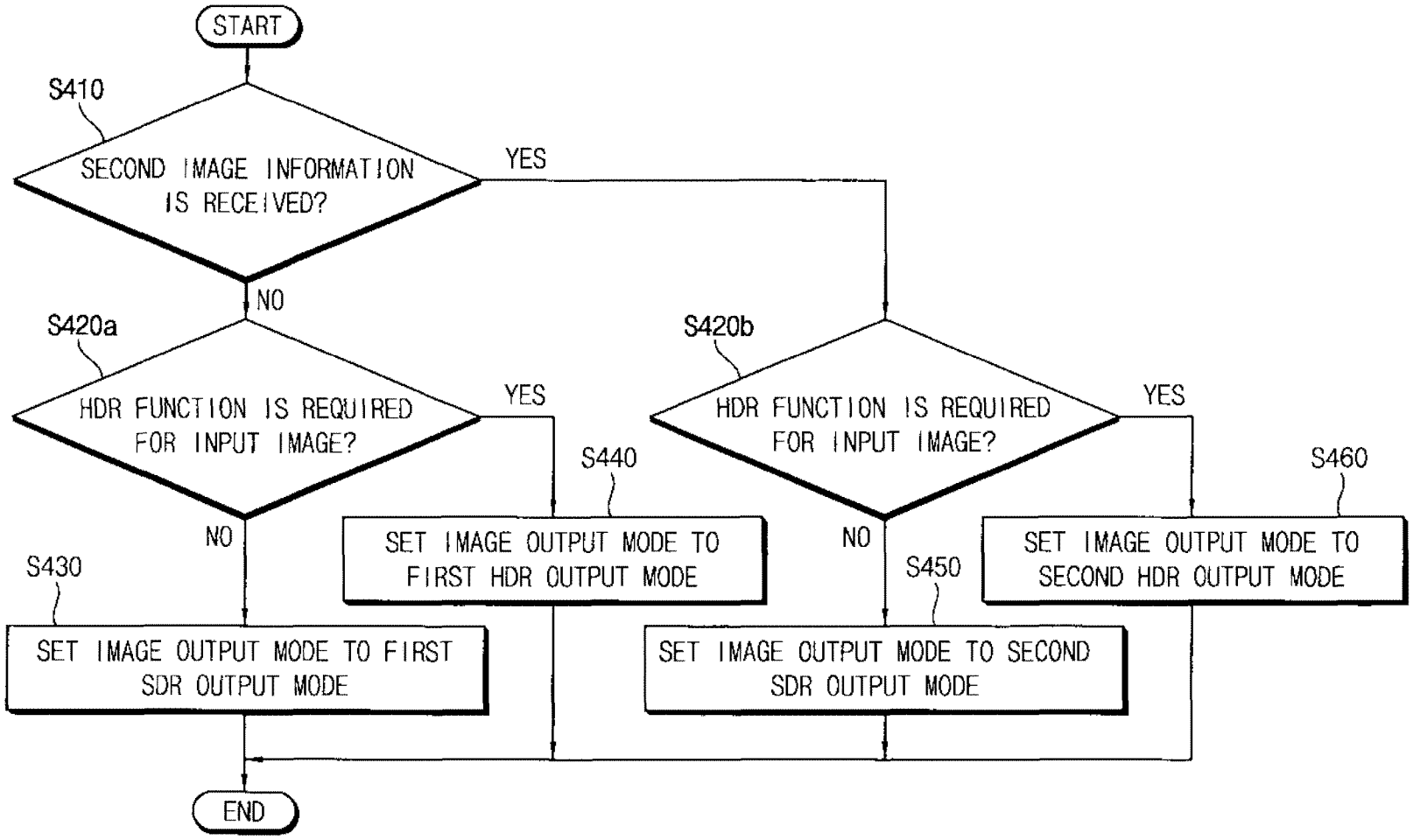
FIG. 7 is a flow diagram illustrating an example of setting an image output mode in FIG. 3.

FIG. 7 is a flow diagram illustrating an example of setting an image output mode in FIG. 3. FIGS. 8A, 8B, 8C, 9A, 9B, 9C, 10A, 10B, 10C, 11A, 11B and 11C are diagrams for describing an operation of FIG. 7. FIGS. 8A, 9A, 10A and 11A illustrate examples of an input luminance histogram. In FIGS. 8A, 9A, 10A and 11A, the horizontal axis indicates input luminance, and the vertical axis indicates the number of pixels N. FIGS. 8B, 9B, 10B and 11B illustrate examples of an output luminance histogram. In FIGS. 8B, 9B, 10B and 11B, the horizontal axis indicates output luminance, and the vertical axis indicates the number of pixels N. FIGS. 8C, 9C, 10C and 11C illustrate examples of a reference tone curve. In FIGS. 8C, 9C, 10C and 11C, the horizontal axis indicates the input luminance, and the vertical axis indicates the output luminance.

Referring to FIGS. 3, 7, 8A, 8B, 8C, 9A, 9B, 9C, 10A, 10B, 10C, 11A, 11B and 11C, in act S400, the result of the determination that is obtained by act S300 in FIG. 3 and the second image information that is obtained by act S200 in FIG. 3 may be used for act S400.

When the second image information is not received (act S410: NO), and when it is determined not to utilize the HDR function for the input image (act S420*a*: NO), the image output mode may be set to a first SDR output mode (act S430).

Figure 8A:
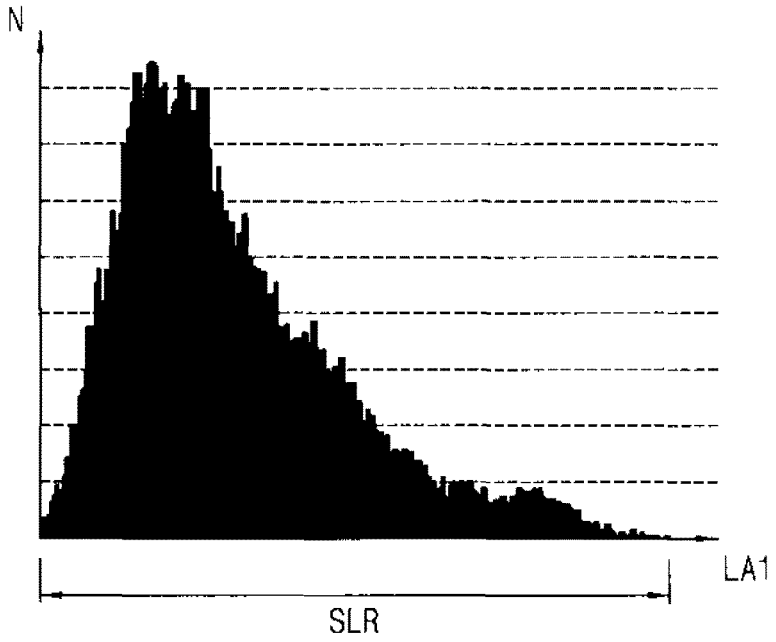
FIGS. 8A-8C, 9A-9C, 10A-10C, and 11A-11C are diagrams for describing an operation of FIG. 7.
Figure 8B:
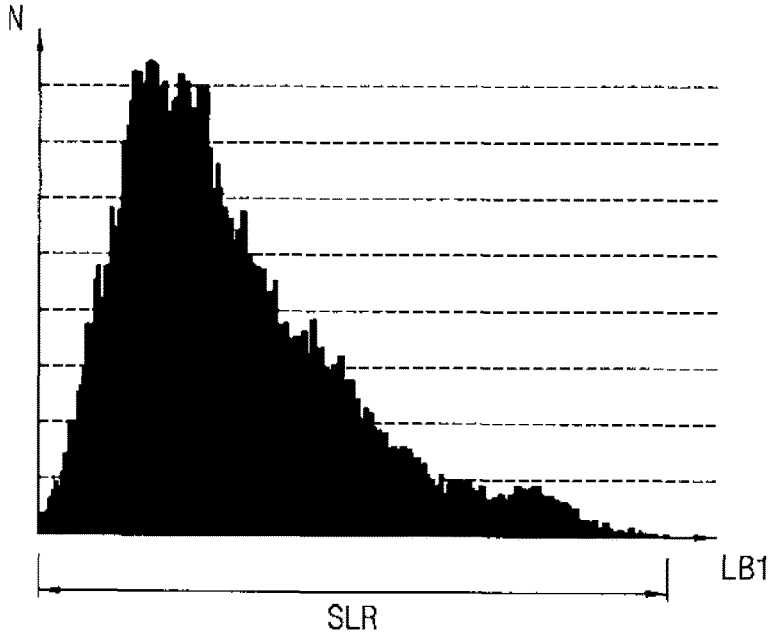

For example, in the first SDR output mode, each of input luminance LA1 of the input image and output luminance LB1 of the output image may have a standard luminance range SLR as illustrated in FIGS. 8A and 8B. In other words, in the first SDR output mode, each of the input image having the input luminance LA1 in FIG. 8A and the output image having the output luminance LB1 in FIG. 8B may be an SDR image. The input luminance histogram of FIG. 8A and the output luminance histogram of FIG. 8B may be substantially the same as each other.

Figure 8C:
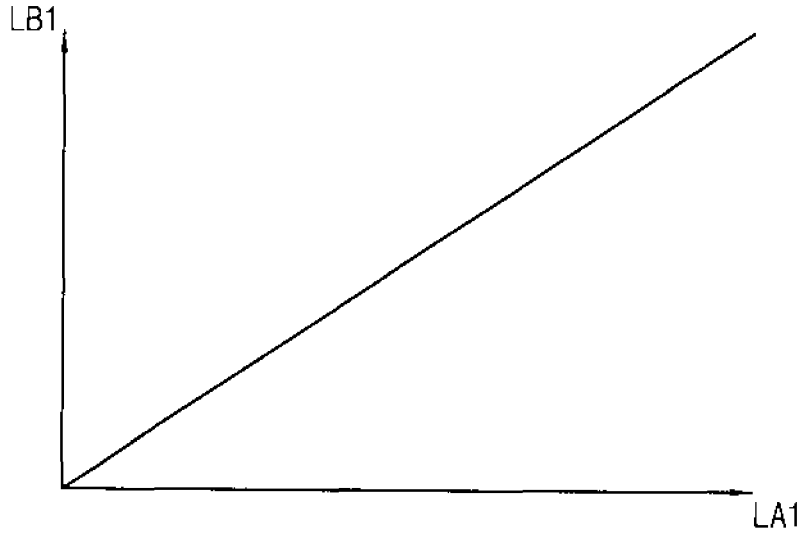

To convert the input luminance histogram of FIG. 8A into the output luminance histogram of FIG. 8B, a reference tone curve may have a linear shape as illustrated in FIG. 8C. In other words, in the reference tone curve of FIG. 8C, the output luminance LB1 may become substantially the same as the input luminance LA1, and a transfer function of the reference tone curve of FIG. 8C may be about 1. An image processing that is performed in the first SDR output mode based on the reference tone curve of FIG. 8C may be referred to as a bypass operation.

When the second image information is not received (act S410: NO), and when it is determined to utilize the HDR function for the input image (act S420*a*: YES), the image output mode may be set to a first HDR output mode (act S440).

Figure 9A:
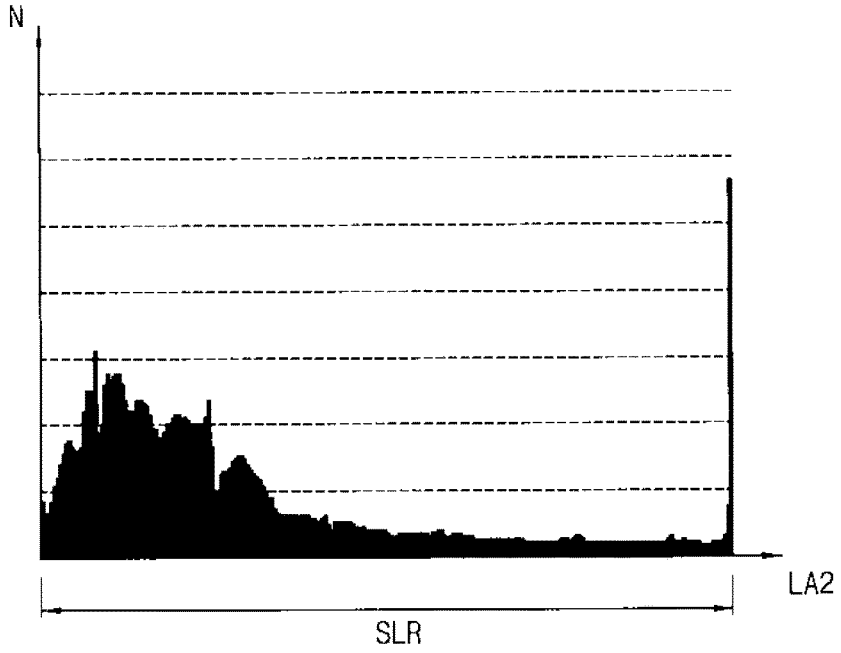
Figure 9B:
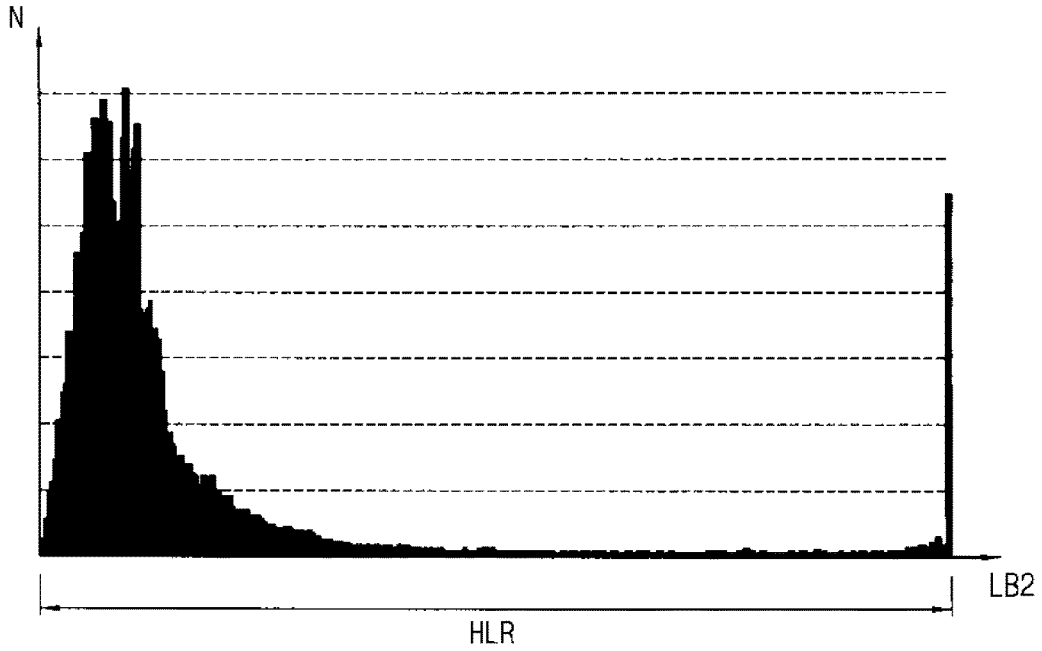

For example, in the first HDR output mode, input luminance LA2 of the input image may have the standard luminance range SLR as illustrated in FIG. 9A, and output luminance LB2 of the output image may have a high luminance range HLR as illustrated in FIG. 9B. In other words, in the first HDR output mode, the input image having the input luminance LA2 in FIG. 9A may be an SDR image, and the output image having the output luminance LB2 in FIG. 9B may be an HDR image.

The input luminance histogram of FIG. 9A and the output luminance histogram of FIG. 9B may be different from each other. In the input luminance histogram of FIG. 9A, the number of pixels having middle luminances (e.g., mid-level luminances) may be relatively large, and the number of pixels having low luminances and high luminances may be relatively small. The middle luminances may be higher than a first threshold luminance, and may be lower than a second threshold luminance. The low luminances may be equal to or lower than the first threshold luminance, and the high luminances may be equal to or higher than the second threshold luminance. In comparison with the input luminance histogram of FIG. 9A, in the output luminance histogram of FIG. 9B, the number of pixels having the middle luminances may be smaller, and the number of pixels having the low luminances and the high luminances may be larger. The input image corresponding to the input luminance histogram of FIG. 9A may be an SDR image having a relatively great luminance contrast. The SDR image corresponding to the input luminance histogram of FIG. 9A may be converted into the HDR image corresponding to the output luminance histogram of FIG. 9B, thereby accentuating (e.g., increasing) the luminance contrast.

Figure 9C:
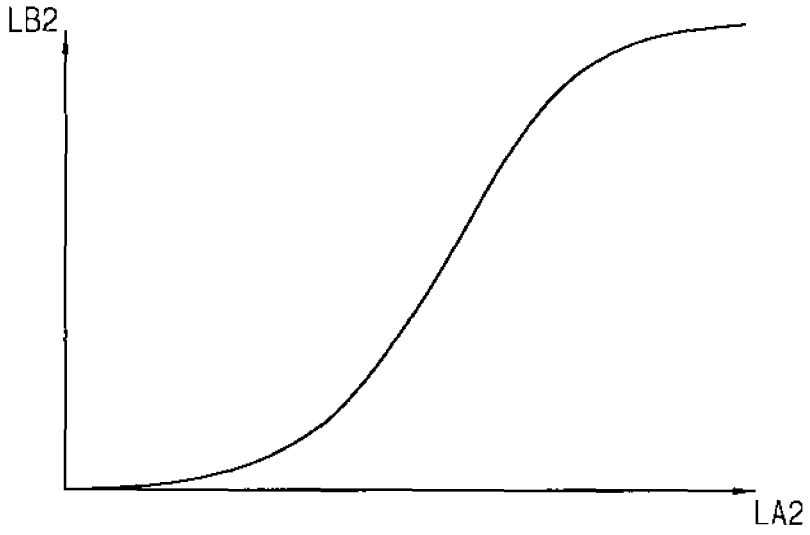

To convert the input luminance histogram of FIG. 9A into the output luminance histogram of FIG. 9B, a reference tone curve may have an S shape as illustrated in FIG. 9C. In the reference tone curve of FIG. 9C, the output luminance LB2 may become less than the input luminance LA2 when the input luminance LA2 corresponds to the low luminances, and the output luminance LB2 may become greater than the input luminance LA2 when the input luminance LA2 corresponds to the high luminances. An image processing that is performed in the first HDR output mode based on the reference tone curve of FIG. 9C may be referred to as an inverse tone mapping operation. To increase or expand the luminance range, additional operation(s) (e.g., dimming, boosting, and/or the like) may be further performed with the inverse tone mapping operation.

When the second image information is received (act S410: YES), and when it is determined not to utilize the HDR function for the input image (act S420*b*: NO), the image output mode may be set to a second SDR output mode (act S450).

Figure 10A:
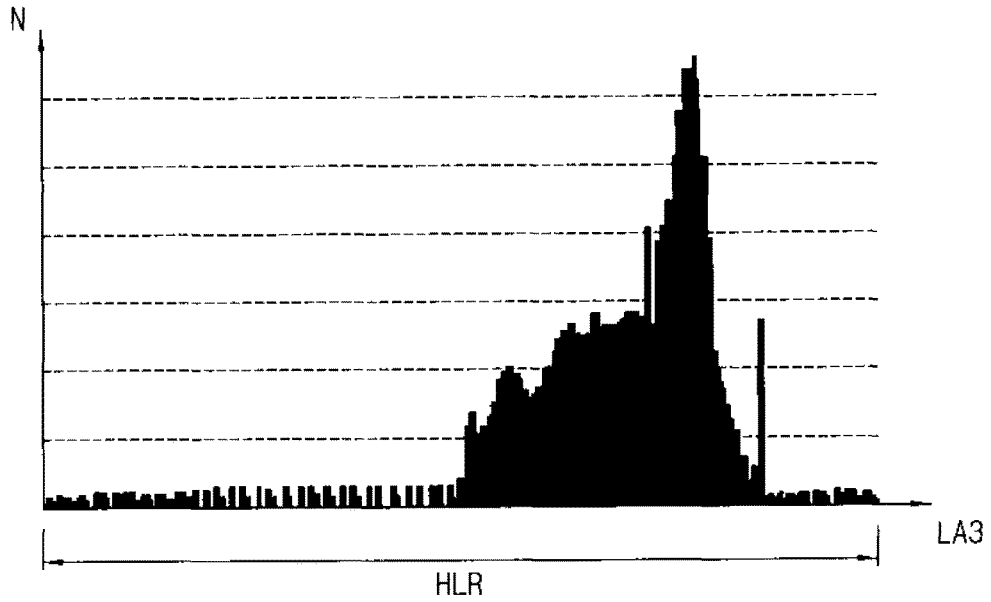
Figure 10B:
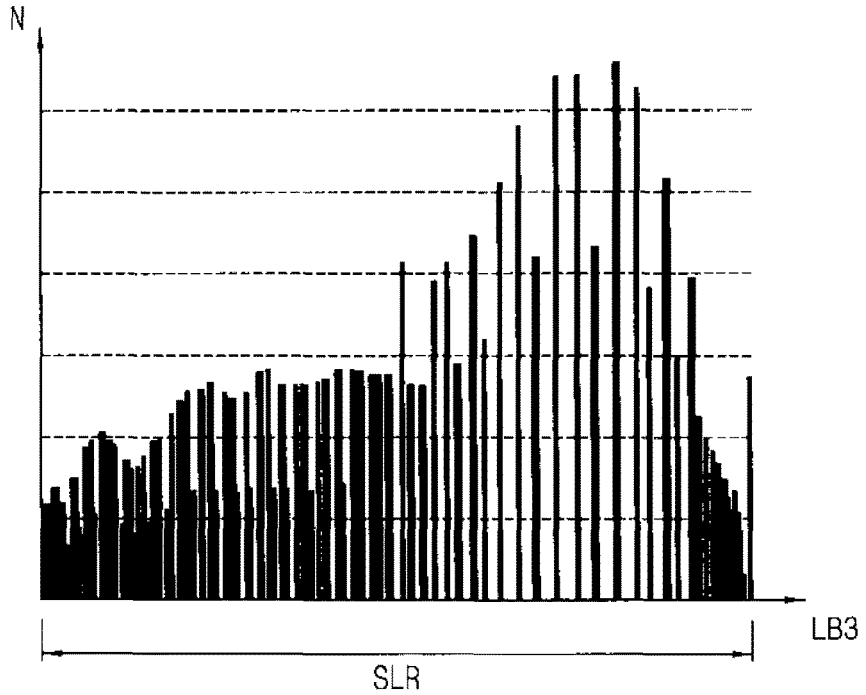

For example, in the second SDR output mode, input luminance LA3 of the input image may have the high luminance range HLR as illustrated in FIG. 10A, and output luminance LB3 of the output image may have the standard luminance range SLR as illustrated in FIG. 10B. In other words, in the second SDR output mode, the input image having the input luminance LA3 in FIG. 10A may be an HDR image, and the output image having the output luminance LB3 in FIG. 10B may be an SDR image.

The input luminance histogram of FIG. 10A and the output luminance histogram of FIG. 10B may be different from each other. The input image corresponding to the input luminance histogram of FIG. 10A may be an HDR image having a relatively narrow luminance distribution. The HDR image corresponding to the input luminance histogram of FIG. 10A may be converted into the SDR image corresponding to the output luminance histogram of FIG. 10B, thereby dispersing (e.g., increasing) the luminance distribution.

Figure 10C:
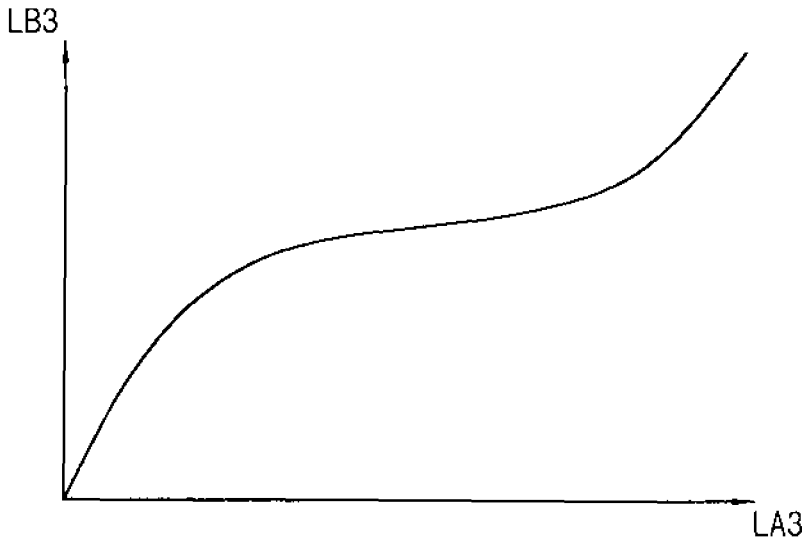

To convert the input luminance histogram of FIG. 10A into the output luminance histogram of FIG. 10B, a reference tone curve may have an inverse S shape as illustrated in FIG. 10C. In the reference tone curve of FIG. 10C, the output luminance LB3 may become greater than the input luminance LA3 when the input luminance LA3 corresponds to the low luminances, and the output luminance LB3 may become less than the input luminance LA3 when the input luminance LA3 corresponds to the high luminances. An image processing that is performed in the second SDR output mode based on the reference tone curve of FIG. 10C may be referred to as a normal tone mapping operation.

When the second image information is received (act S410: YES), and when it is determined to utilize the HDR function for the input image (act S420*b*: YES), the image output mode may be set to a second HDR output mode (act S460).

Figure 11A:
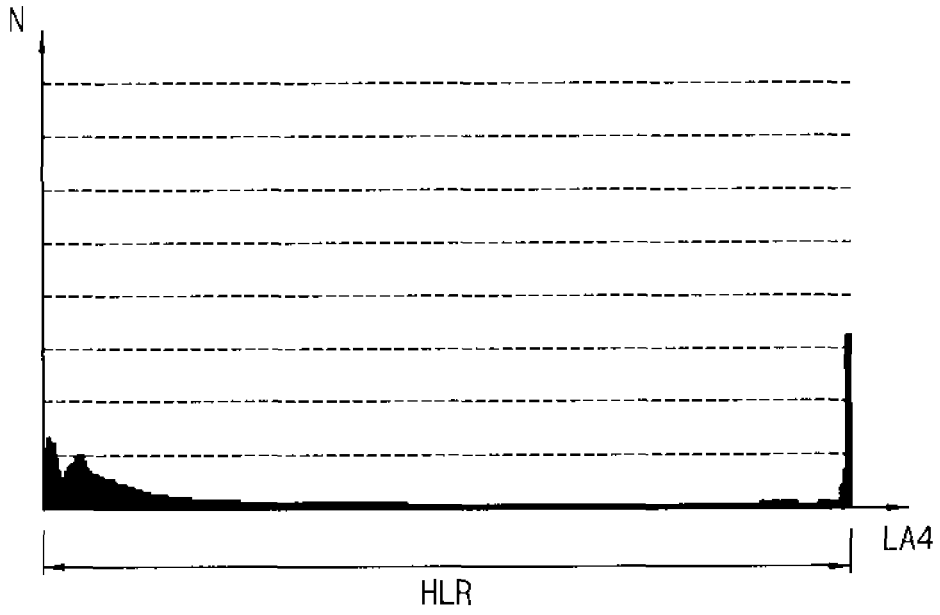
Figure 11B:
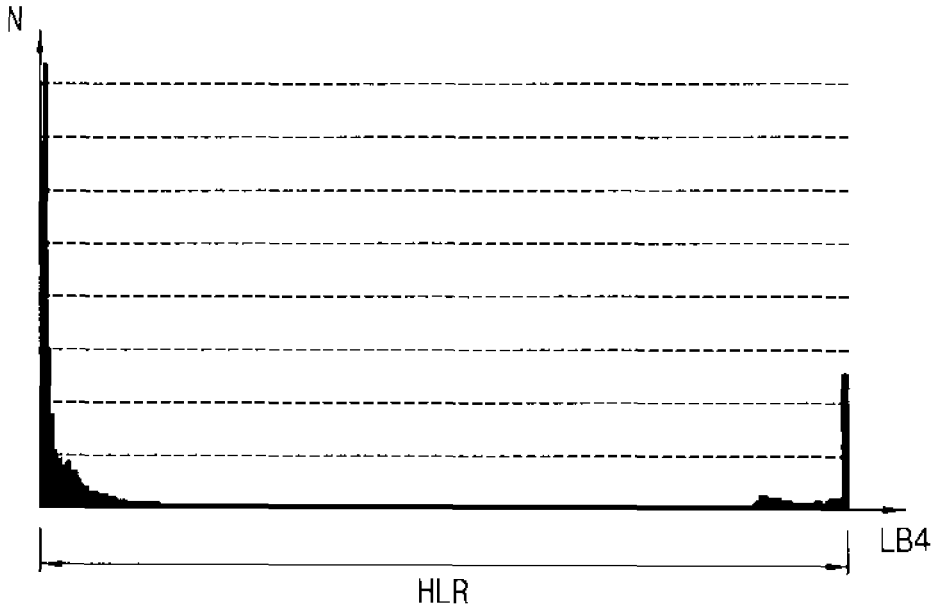

For example, in the second HDR output mode, each of input luminance LA4 of the input image and output luminance LB4 of the output image may have the high luminance range HLR as illustrated in FIGS. 11A and 11B. In other words, in the second HDR output mode, each of the input image having the input luminance LA4 in FIG. 11A and the output image having the output luminance LB4 in FIG. 11B may be an HDR image.

The input luminance histogram of FIG. 11A and the output luminance histogram of FIG. 11B may be different from each other. In comparison with the input luminance histogram of FIG. 11A, the number of pixels having the low luminances and the high luminances may be larger in the output luminance histogram of FIG. 11B. The HDR image corresponding to the input luminance histogram of FIG. 11A may be converted into the HDR image corresponding to the output luminance histogram of FIG. 11B, thereby accentuating the luminance contrast.

Figure 11C:
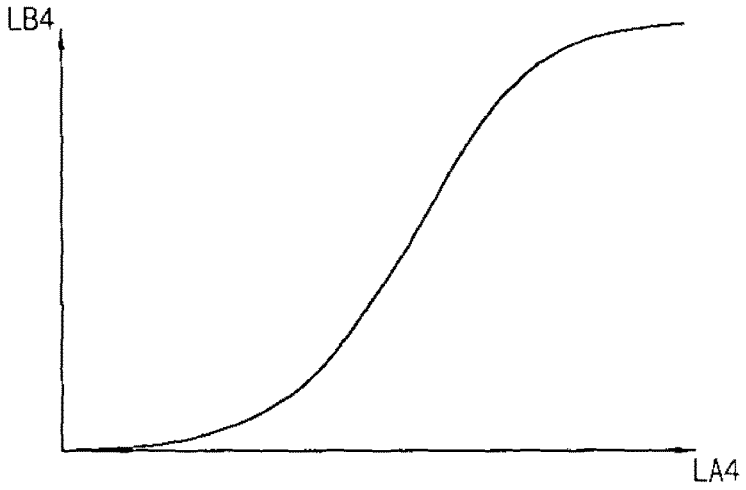

To convert the input luminance histogram of FIG. 11A into the output luminance histogram of FIG. 11B, a reference tone curve may have an S shape as illustrated in FIG. 11C. The reference tone curve of FIG. 11C may be similar to the reference tone curve of FIG. 9C.

In some exemplary embodiments, acts S410 through S460 may be performed by the image processor 230. For example, the image processor 230 may include a mode setting unit (e.g., a mode setter) for performing acts S410 through S460.

In some exemplary embodiments, as described with reference to FIG. 3, act S200 in FIG. 3 may be omitted, and then acts S410, S420*b*, S450 and S460 of FIG. 7 may also be omitted.

Figure 12:
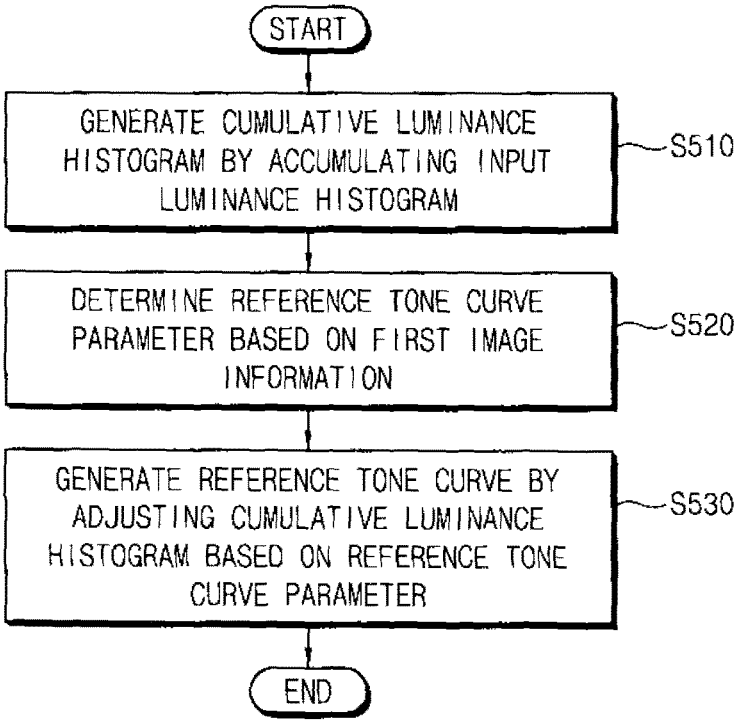
FIG. 12 is a flow diagram illustrating an example of setting a reference tone curve in FIG. 3.
Figure 13A:
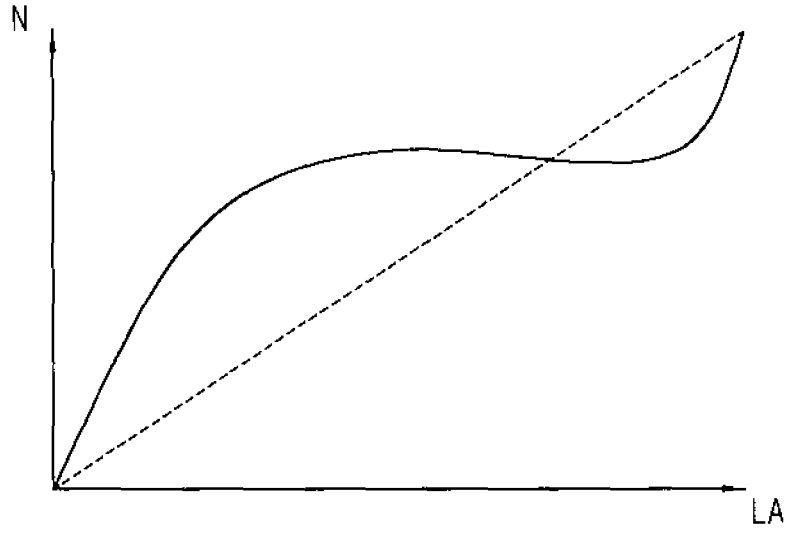
FIGS. 13A-13C are diagrams for describing an operation of FIG. 12.
Figure 13B:
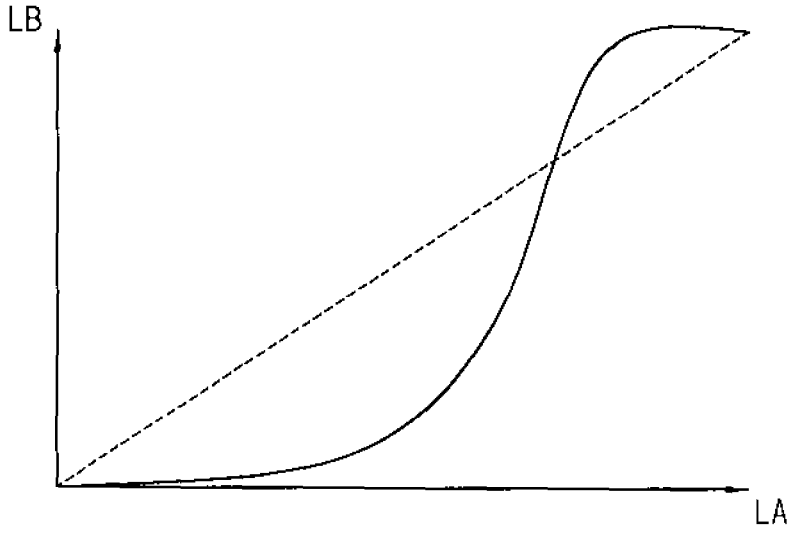
Figure 13C:
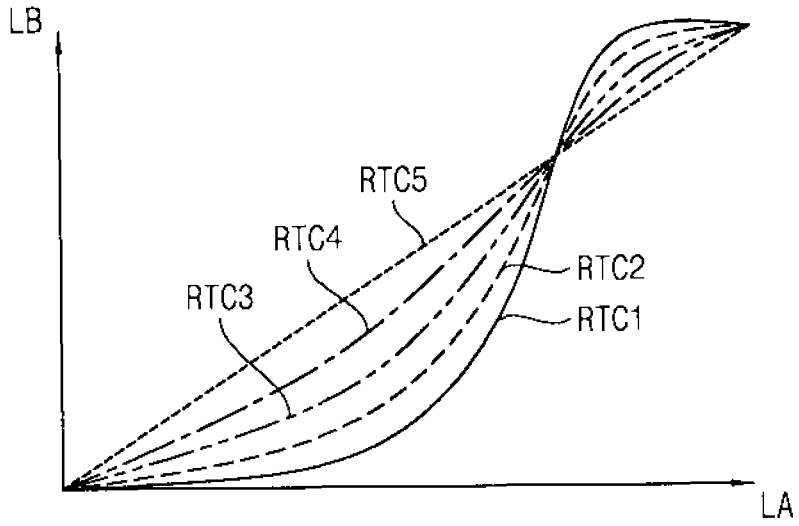

FIG. 12 is a flow diagram illustrating an example of setting a reference tone curve in FIG. 3. FIGS. 13A, 13B, and 13C are diagrams for describing an operation of FIG. 12. FIG. 13A illustrates an example of a cumulative luminance histogram. In FIG. 13A, the horizontal axis indicates input luminance LA, and the vertical axis indicates the number of pixels N. FIGS. 13B and 13C illustrate examples of a reference tone curve. In FIGS. 13B and 13C, the horizontal axis indicates the input luminance LA, and the vertical axis indicates output luminance LB.

Referring to FIGS. 3, 12, 13A, 13B, and 13C, in act S500, a cumulative luminance histogram may be generated by accumulating (e.g., integrating) an input luminance histogram of the input image (act S510). For example, a cumulative luminance histogram of FIG. 13A may be obtained by accumulating the input luminance histogram of FIG. 9A. In FIG. 13A, a solid line may indicate the cumulative luminance histogram, and a dotted line may indicate a bypass line corresponding to the reference tone curve of FIG. 8C.

A reference tone curve parameter may be determined based on the first image information (act S520). For example, the reference tone curve parameter may be determined based on at least one of the image type (or kind) of the input image, the illuminance LU of the display circumstances and the luminance range of the backlight circuit 500 that are obtained by acts S130, S140 and S150 in FIG. 4.

The reference tone curve may be generated by adjusting the cumulative luminance histogram based on the reference tone curve parameter (act S530). For example, a tone curve of FIG. 13B may be obtained by reversing the cumulative luminance histogram of FIG. 13A with respect to the bypass line (e.g., the dotted line). The tone curve of FIG. 13B may be adjusted to a plurality of tone curves RTC1, RTC2, RTC3, RTC4 and RTC5 of FIG. 13C depending on the reference tone curve parameter. One of the plurality of tone curves RTC1 to RTC5 of FIG. 13C may be selected and may be provided as the reference tone curve.

If the tone curve of FIG. 13B is used as it is (e.g., without further adjustment) for converting the input image, the HDR function for the input image may not be completely effective. For example, a luminance range of the input image may be different from the luminance range of the backlight circuit 500, and thus tone adjusting may be desirable based on the luminance range of the backlight circuit 500. The tone curve of FIG. 13B may not be obtained from a real scene, but obtained from the input image, and thus image quality may be degraded while the input image is converted. When the input image corresponds to a dynamic image having sudden luminance change, blinking may be recognized by a user. An optimized HDR processing may not be fixed, but changed due to illuminance, color temperature, circumstances where the display apparatus 10 is set up or installed and/or the like. Thus, the reference tone curve parameter may be obtained based on characteristics of the display apparatus 10, the input image, the circumstances, and/or the like, and then, an optimized reference tone curve may be set based on the reference tone curve parameter.

In some exemplary embodiments, the reference tone curve parameter may be equal to or greater than about 0 and may be equal to or less than about 1. For example, the plurality of tone curves RTC1 to RTC5 of FIG. 13C may be generated based on the reference tone curve parameter of about 1, 0.75, 0.5, 0.25 and 0, respectively. The tone curve RTC1 of FIG. 13C generated based on the reference tone curve parameter of about 1 may be substantially the same as the tone curve of FIG. 13B. The tone curve RTC5 of FIG. 13C generated based on the reference tone curve parameter of about 0 may be substantially the same as the bypass line.

In some exemplary embodiments, acts S510 through S530 may be performed by the image processor 230. For example, the image processor 230 may include a tone curve setting unit (e.g., a tone curve setter) for performing acts S510 through S530.

Although an example operation of generating the reference tone curve in the first HDR output mode is only described with reference to FIGS. 13A, 13B and 13C, operations of generating the reference tone curve in the second SDR and HDR output modes may be similar to that in the first HDR output mode.

In act S600, an output luminance histogram of the output image may be generated by mapping the input luminance histogram of the input image based on the reference tone curve.

In the first HDR output mode and the second HDR output mode (e.g., when it is determined to utilize the HDR function for the input image), the output luminance histogram may be generated by performing the inverse tone mapping operation on the input luminance histogram. For example, the input luminance histogram of FIG. 9A may be mapped into the output luminance histogram of FIG. 9B based on the reference tone curve of FIG. 9C. The input luminance histogram of FIG. 11A may be mapped into the output luminance histogram of FIG. 11B based on the reference tone curve of FIG. 11C.

In the second SDR output mode, the output luminance histogram may be generated by performing the normal tone mapping operation on the input luminance histogram. For example, the input luminance histogram of FIG. 10A may be mapped into the output luminance histogram of FIG. 10B based on the reference tone curve of FIG. 10C.

In the first SDR output mode, the output luminance histogram may be generated by performing the bypass operation on the input luminance histogram. For example, act S500 may be omitted, the reference tone curve of FIG. 8C may be pre-stored (e.g., in memory), and the input luminance histogram of FIG. 8A may be mapped into the output luminance histogram of FIG. 8B based on the reference tone curve of FIG. 8C. For another example, acts S500 and S600 may be omitted, and the input luminance histogram of FIG. 8A may be output as the output luminance histogram of FIG. 8B.

In some exemplary embodiments, act S600 may be performed by the image processor 230. For example, the image processor 230 may include a converting unit (e.g., a converter) for performing act S600.

Figure 14:
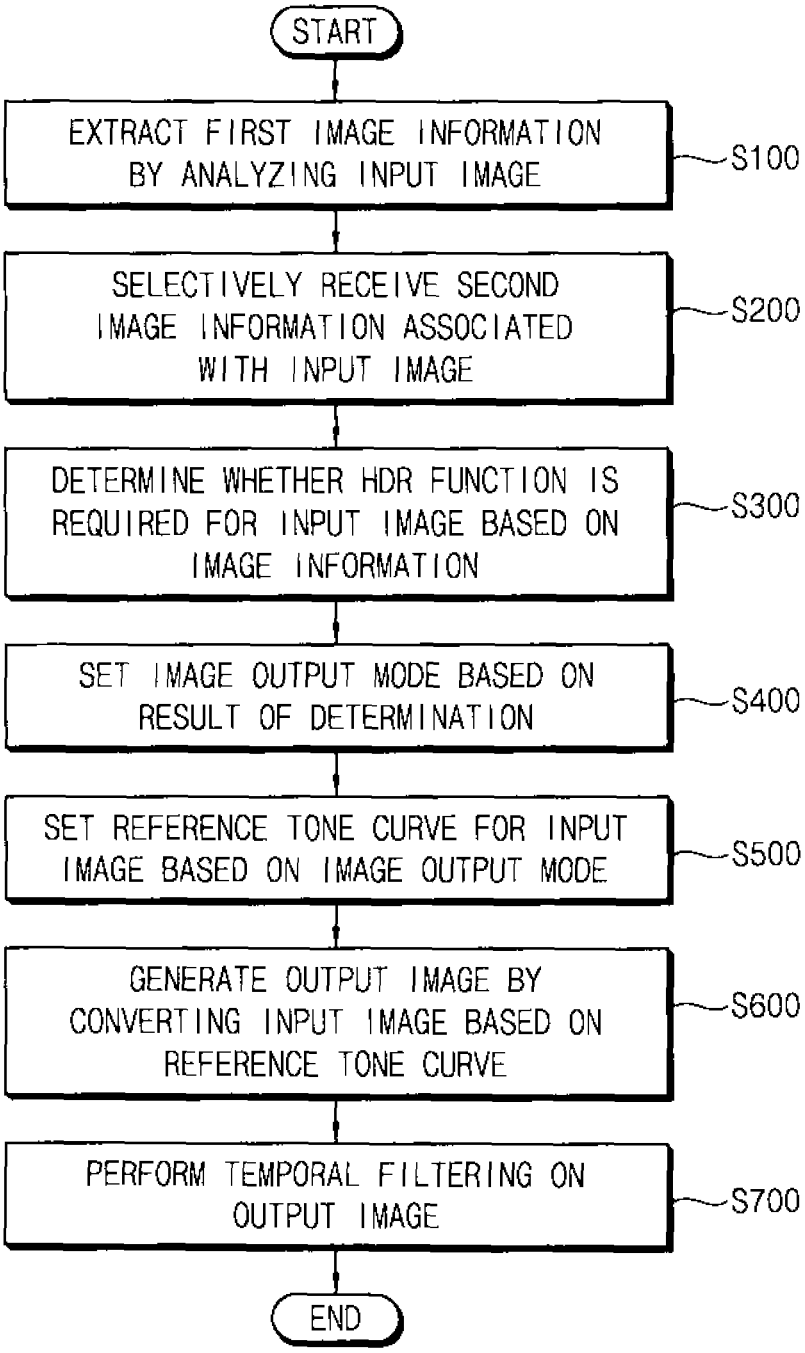
FIG. 14 is a flow diagram illustrating a method of image processing according to some exemplary embodiments of the present disclosure.

FIG. 14 is a flow diagram illustrating a method of image processing according to exemplary embodiments of the present disclosure.

Referring to FIGS. 1, 2 and 14, in a method of image processing according to exemplary embodiments, first image information is extracted from an input image by analyzing the input image (act S100). Second image information associated with the input image may be selectively received (act S200). It is determined whether to utilize the HDR function for the input image based on the image information (act S300). An image output mode is set based on a result of the determination (act S400). A reference tone curve that is suitable for the input image is set based on the image output mode (act S500). An output image is generated by converting the input image based on the reference tone curve (act S600). Acts S100 through S600 of FIG. 14 may be substantially the same as acts S100 through S600 in FIG. 3, respectively.

A temporal filtering may be performed on the output image (act S700). The temporal filtering may prevent the reference tone curve from drastically changing.

Figure 15A:
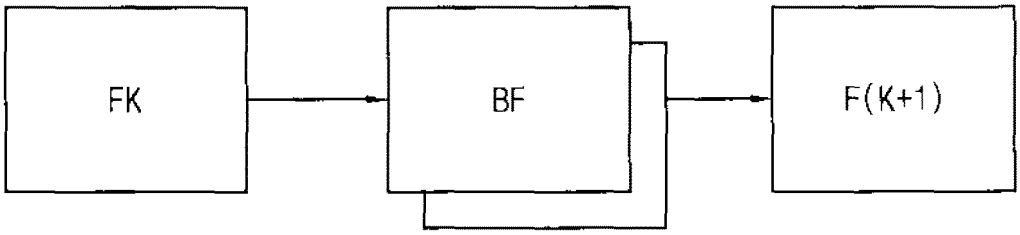
FIGS. 15A-15B are diagrams for describing an operation of performing a temporal filtering in FIG. 14.
Figure 15B:
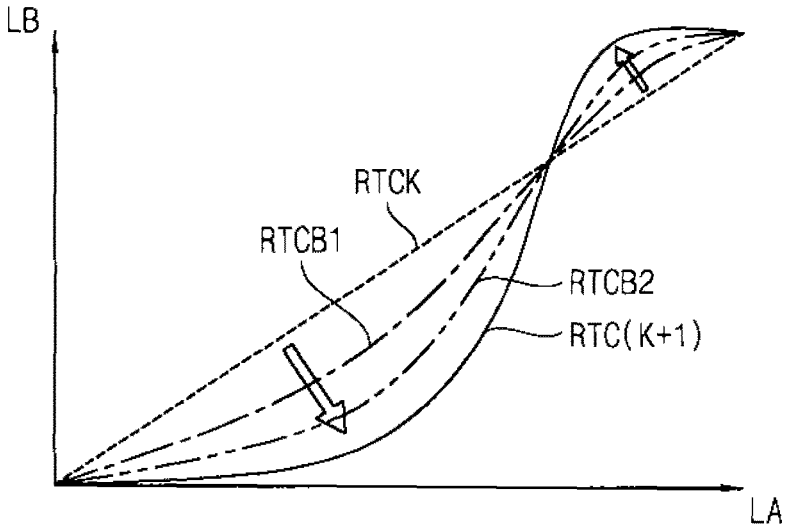

FIGS. 15A and 15B are diagrams for describing an operation of performing a temporal filtering in FIG. 14. FIG. 15A illustrates a change of frame images based on the temporal filtering. FIG. 15B illustrates a change of the reference tone curve based on the temporal filtering. In FIG. 15B, the horizontal axis indicates the input luminance LA, and the vertical axis indicates the output luminance LB.

Referring to FIGS. 14, 15A and 15B, in act S700, at least one buffer frame image may be inserted between a current frame image F(K+1) and a previous frame image FK. The current frame image F(K+1) may correspond to the output image generated by act S600. The previous frame image FK may correspond to an image being processed prior to the output image or the current frame image F(K+1). For example, two buffer frame images BF may be inserted as illustrated in FIG. 15A.

In some exemplary embodiments, as illustrated in FIG. 15B, values on reference tone curves RTCB1 and RTCB2 of the buffer frame images BF may be middle values between values on a reference tone curve RTCK of the previous frame image FK and values on a reference tone curve RTC(K+1) of the current frame image F(K+1). For example, the reference tone curve RTCB1 of a first buffer frame image that is adjacent to the previous frame image FK may be similar to (or resemble) the reference tone curve RTCK. The reference tone curve RTCB2 of a second buffer frame image that is adjacent to the current frame image F(K+1) may be similar to (or resemble) the reference tone curve RTC(K+1). The reference tone curves RTCB1 and RTCB2 of the buffer frame images BF may be generated based on at least one temporal factor that is similar to the reference tone curve parameter.

When the temporal filtering is not performed, the previous frame image FK may be a K-th frame image, and the current frame image F(K+1) may be a (K+1)-th frame image, where K is a natural number. When the frame images FK and F(K+1) are sequentially displayed, blinking may be recognized by a user because of sudden luminance change due to sudden change between the reference tone curves RTCK and RTC(K+1) of two consecutive frame images FK and F(K+1).

As illustrated in FIGS. 15A and 15B, when the temporal filtering is performed, the previous frame image FK may be a K-th frame image, the buffer frame images BF may be (K+1)-th and (K+2)-th frame images, and the current frame image F(K+1) may be a (K+3)-th frame image. When the frame images FK, BF and F(K+1) are sequentially displayed, the reference tone curve may be gradually changed for several frames, and thus it may prevent the reference tone curve from drastically changing.

In some exemplary embodiments, act S700 may be performed by the image processor 230. For example, the image processor 230 may include a storage unit (e.g., a storage) for storing the reference tone curve of the previous frame image, and a temporal filtering unit (e.g., a temporal filter) for generating the reference tone curves of the buffer frame images and performing the temporal filtering.

Although an example operation of inserting two buffer frame images is described with reference to FIGS. 15A and 15B, the number of inserted buffer frame images for the temporal filtering may be changed.

Although examples where the method of image processing according to exemplary embodiments are performed by the timing controller 200 included in the display apparatus 10 are described, the method of image processing according to exemplary embodiments may be performed by any image processing device that is located inside or outside the display apparatus 10.

As will be appreciated by those skilled in the art, the present disclosure may be embodied as a system, method, computer program product, and/or a computer program product embodied in one or more computer readable medium(s) having computer readable program code embodied thereon. The computer readable program code may be provided to a processor of a general purpose computer, special purpose computer, or other programmable data processing apparatus. The computer readable medium may be a computer readable signal medium or a computer readable storage medium. The computer readable storage medium may be any tangible medium that can contain, or store a program for use by or in connection with an instruction execution system, apparatus, or device. For example, the computer readable medium may be a non-transitory computer readable medium.

Figure 16:
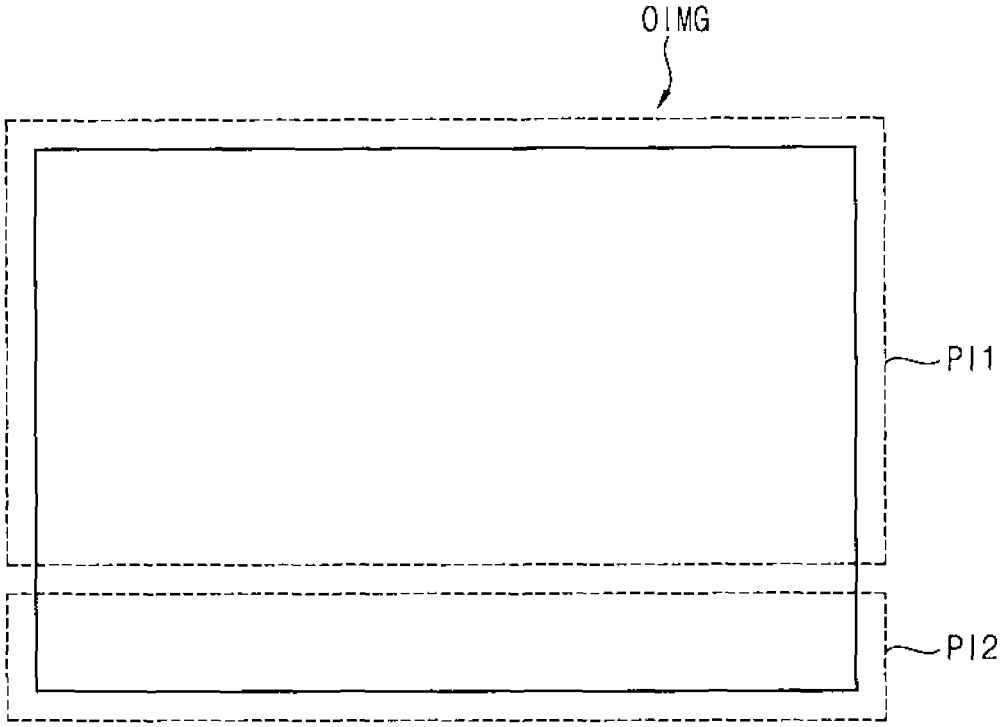
FIG. 16 is a diagram illustrating an example of an output image generated by a method of image processing according to some exemplary embodiments of the present disclosure.
Figure 17A:
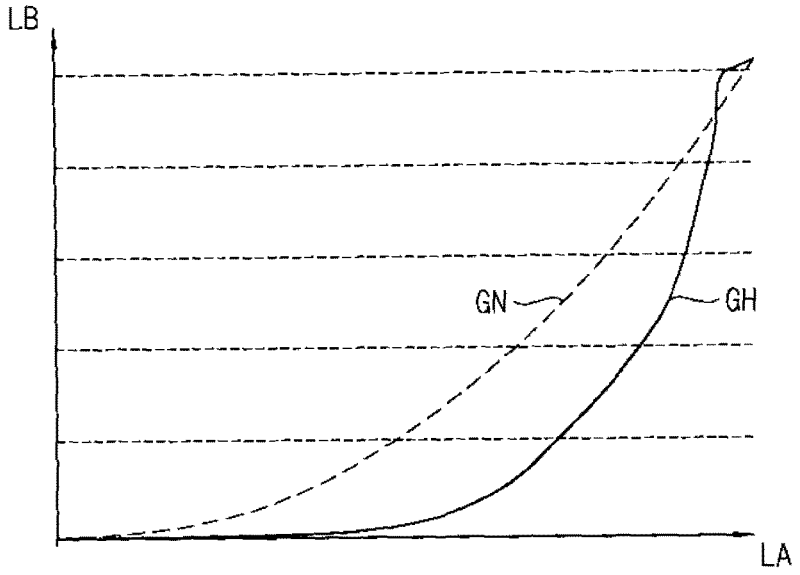
FIGS. 17A-17B and 18A-18C are diagrams for describing a characteristic of the output image of FIG. 16.
Figure 17B:
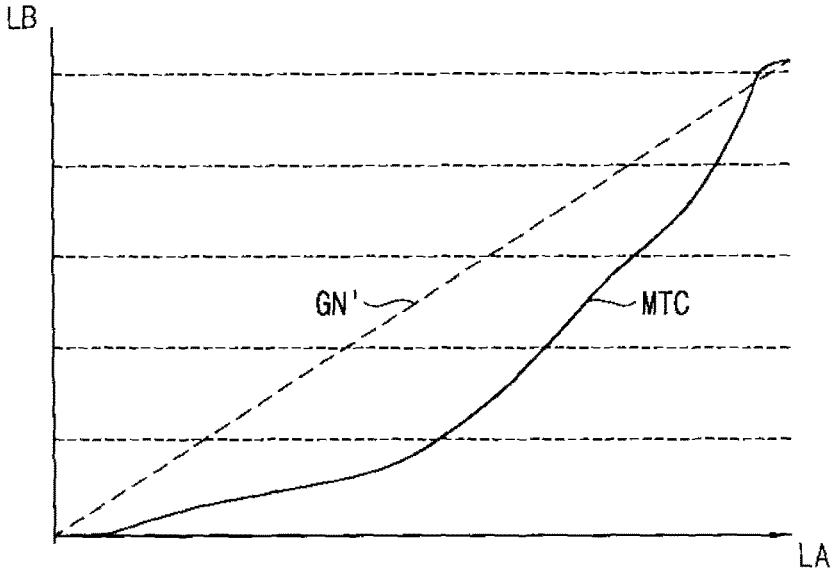
Figure 18A:
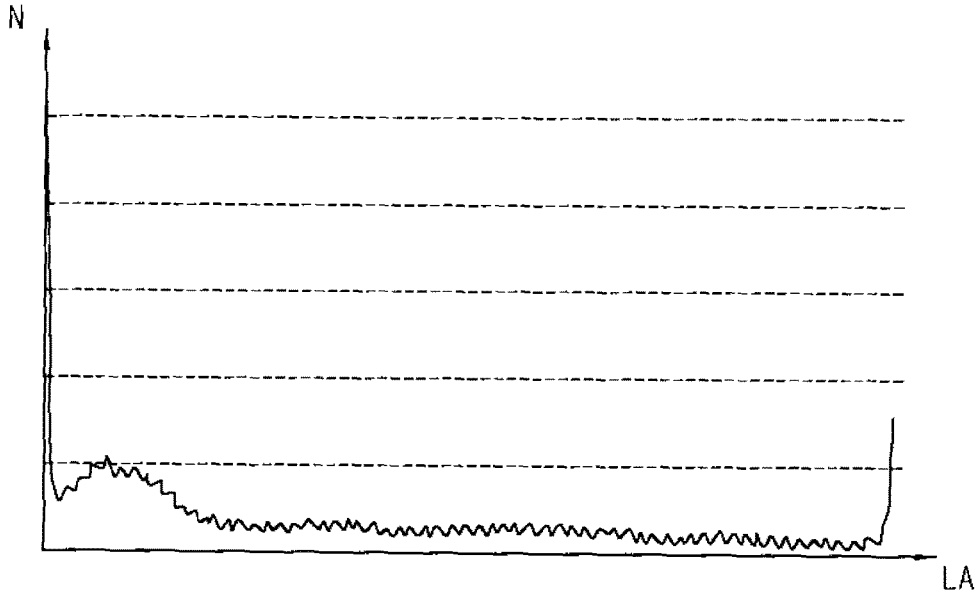
Figure 18B:
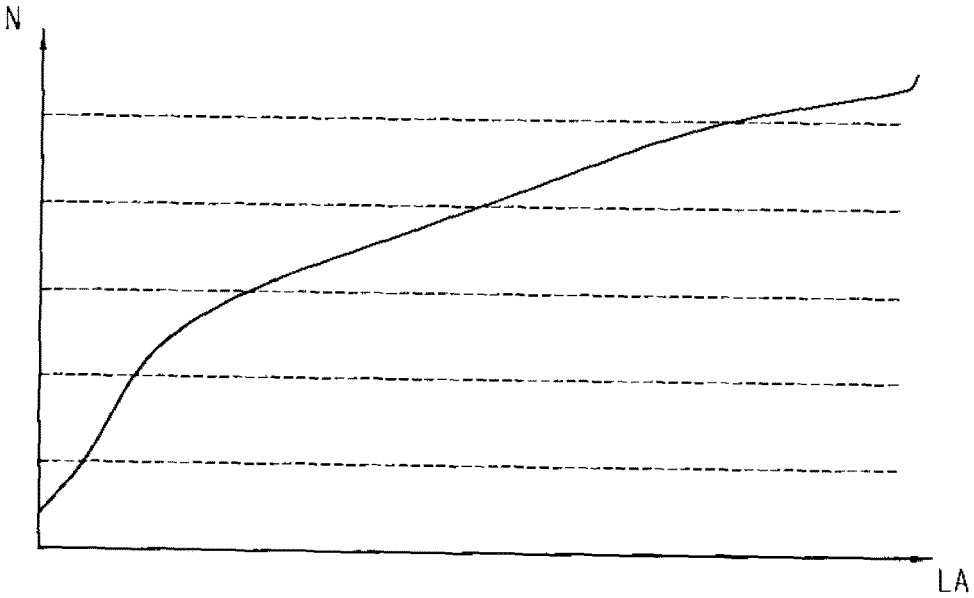
Figure 18C:
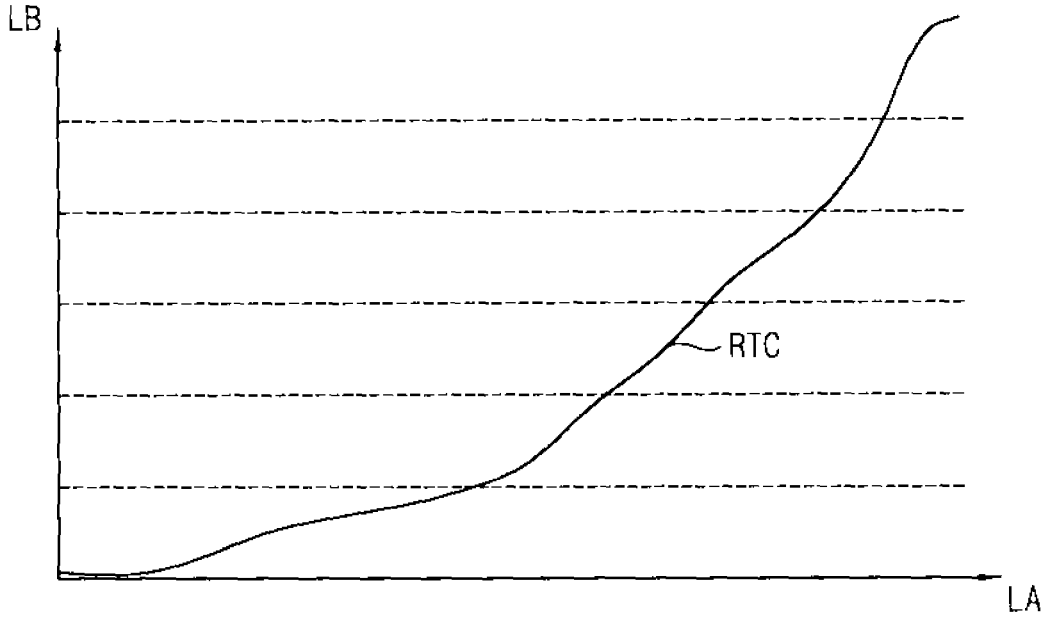

FIG. 16 is a diagram illustrating an example of an output image generated by a method of image processing according to exemplary embodiments of the present disclosureact. FIGS. 17A, 17B, 18A, 18B and 18C are diagrams for describing a characteristic of the output image of FIG. 16. FIGS. 17A and 17B illustrate a gamma curve and a measured tone curve, respectively, that are obtained by measuring luminance of the output image of FIG. 16. In FIGS. 17A and 17B, the horizontal axis indicates the input luminance LA, and the vertical axis indicates output luminance LB. FIGS. 18A and 18B illustrate luminance histograms of the output image of FIG. 16. In FIGS. 18A and 18B, the horizontal axis indicates the input luminance LA, and the vertical axis indicates the number of pixels N. FIG. 18C illustrates a reference tone curve that is used for generating the output image of FIG. 16. In FIG. 18C, the horizontal axis indicates the input luminance LA, and the vertical axis indicates output luminance LB.

Referring to FIGS. 16, 17A, 17B, 18A, 18B and 18C, after the output image is generated by applying the HDR function to the input image, a measured tone curve of the output image may be matched to the reference tone curve. The measured tone curve may be obtained by measuring luminance of the output image displayed on the display panel 100.

For example, as illustrated in FIG. 16, an output image OIMG that is generated by applying the HDR function to the input image may include a first partial image PI1 and a second partial image PI2. The first partial image PI1 may be a normal image including an object, a background, and/or the like. The second partial image PI2 may be a test image including a grayscale bar that sequentially displays all grayscale avluess from a minimum grayscale value (e.g., about 0) to a maximum grayscale value (e.g., about 255).

Luminance of the second partial image PI2 of the HDR applied output image OIMG may be measured by a measurement device, and a measured tone curve may be obtained based on the measured luminance. For example, an HDR applied gamma curve GH may be obtained by measuring the luminance of the second partial image PI2 as illustrated in FIG. 17A. The HDR applied gamma curve GH may be different from a reference gamma curve GN that is a gamma curve with a gamma value of about 2.2. The reference gamma curve GN of FIG. 17A may be mapped into a straight line GN' of FIG. 17B, and then the HDR applied gamma curve GH of FIG. 17A may be mapped into a measured tone curve MTC of FIG. 17B based on a relationship between the reference gamma curve GN and the straight line GN'.

As illustrated in FIG. 18A, a luminance histogram of an input image corresponding to the whole output image OIMG may be obtained. As illustrated in FIG. 18B, a cumulative luminance histogram may be obtained by accumulating the luminance histogram of FIG. 18A. As illustrated in FIG. 18C, a reference tone curve RTC may be obtained by normalizing and reversing (e.g., reversing with respect to a bypass line) the cumulative luminance histogram of FIG. 18B. The reference tone curve RTC of FIG. 18C obtained by above described operations may be substantially the same as the reference tone curve obtained by act S500 in FIG. 3.

When the measured tone curve MTC of FIG. 17B is matched to the reference tone curve RTC of FIG. 18C, it may be determined that the HDR function is applied to the output image OIMG of FIG. 16 according to exemplary embodiments.

In some exemplary embodiments, the sentence "the measured tone curve MTC is matched to the reference tone curve RTC" may represent that the measured tone curve MTC is substantially the same as the reference tone curve RTC. In other exemplary embodiments, the sentence "the measured tone curve MTC is matched to the reference tone curve RTC" may represent that the measured tone curve MTC is correlated with the reference tone curve RTC, and a correlation index and/or a similarity index between the measured tone curve MTC and the reference tone curve RTC is greater than a reference index.

In some exemplary embodiments, to determine whether the HDR function is applied to the output image OIMG according to exemplary embodiments, additional operations of varying the output image OIMG and the luminance histogram and checking whether the measured tone curve MTC and the reference tone curve RTC are changed with correlationship based on the variation may be further performed. For example, the output image OIMG and the luminance histogram may be varied by replacing a part of the first partial image PI1 in the output image OIMG with a high grayscale value image (e.g., a white box).

The above described embodiments may be used in a display apparatus and/or a system including the display apparatus, such as a mobile phone, a smart phone, a personal digital assistant (PDA), a portable multimedia player (PMP), a digital camera, a digital television, a set-top box, a music player, a portable game console, a navigation device, a personal computer (PC), a server computer, a workstation, a tablet computer, a laptop computer, or the like.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display apparatus and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display apparatus may be formed on one integrated circuit (IC) chip or on separate IC chips. Further, the various components of the display apparatus may be implemented on a flexible printed circuit film, a tape carrier package (TCP), a printed circuit board (PCB), or formed on a same substrate. Further, the various components of the display apparatus may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims, and equivalents thereof.

What is claimed is:

1. A method of image processing, the method comprising:

extracting first image information from an input image by analyzing the input image;

determining, based on the first image information, whether to utilize a high dynamic range (HDR) function for the input image;

setting an image output mode based on a result of the determination;

setting a reference tone curve for the input image based on the image output mode; and generating an output image by converting the input image based on the reference tone curve.

2. The method of claim 1, wherein the extracting of the first image information comprises:

obtaining color space information from the input image;

obtaining a first peak luminance, a second peak luminance, and an average luminance from the input image; and obtaining a first value corresponding to the first peak luminance in the input image, a second value corresponding to the second peak luminance in the input image, and a third value corresponding to the average luminance in the input image.

3. The method of claim 2, wherein the determining of whether to utilize the HDR function for the input image comprises:

determining whether a difference between the first and second peak luminances is greater than a reference luminance;

determining whether each of a difference between the first and third values and a difference between the second and third values is greater than a first reference value; and determining whether the third value is less than a second reference value.

4. The method of claim 3, wherein it is determined to utilize the HDR function for the input image when the difference between the first and second peak luminances is greater than the reference luminance, when both the difference between the first and third values and the difference between the second and third values are greater than the first reference value, and when the third value is less than the second reference value.

5. The method of claim 1, wherein the setting of the image output mode comprises:

setting the image output mode to a first standard dynamic range (SDR) output mode when it is determined not to utilize the HDR function for the input image; and setting the image output mode to a first HDR output mode when it is determined to utilize the HDR function for the input image.

6. The method of claim 5, further comprising:

selectively receiving second image information associated with the input image, wherein setting the image output mode further comprises:

setting the image output mode to a second SDR output mode when the second image information is received, and when it is determined not to utilize the HDR function for the input image; and setting the image output mode to a second HDR output mode when the second image information is received, and when it is determined to utilize the HDR function for the input image.

7. The method of claim 1, wherein the setting of the reference tone curve comprises:

generating a cumulative luminance histogram by accumulating an input luminance histogram of the input image;

determining a reference tone curve parameter based on the first image information; and generating the reference tone curve by adjusting the cumulative luminance histogram based on the reference tone curve parameter.

8. The method of claim 7, wherein the extracting of the first image information comprises:

determining whether an image type of the input image corresponds to a static image or a dynamic image;

obtaining, by an illuminance sensor, illuminance of display circumstances in which the output image is to be displayed; and obtaining a luminance range of a backlight circuit in a display panel on which the output image is to be displayed, wherein the reference tone curve parameter is determined based on at least one of the image type of the input image, the illuminance of the display circumstances, and the luminance range of the backlight circuit.

9. The method of claim 1, wherein the generating of the output image comprises:

generating an output luminance histogram of the output image by mapping an input luminance histogram of the input image based on the reference tone curve.

10. The method of claim 9, wherein the output luminance histogram is generated by performing an inverse tone mapping on the input luminance histogram when it is determined to utilize the HDR function for the input image.

11. The method of claim 1, further comprising:

performing a temporal filtering on the output image.

12. The method of claim 11, wherein the performing of the temporal filtering comprises:

inserting at least one buffer frame image between a current frame image and a previous frame image, the current frame image corresponding to the output image, the previous frame image corresponding to an image being processed prior to the output image.

13. The method of claim 1, wherein a measured tone curve of the output image is matched to the reference tone curve after the output image is generated by applying the HDR function to the input image, the measured tone curve being obtained by measuring luminance of the output image displayed on a display panel.

14. A display apparatus comprising:

a timing controller configured to extract first image information from an input image by analyzing the input image, to determine, based on the first image information, whether to utilize a high dynamic range (HDR) function for the input image, to set an image output mode based on a result of the determination, to set a reference tone curve for the input image based on the image output mode, and to generate an output image by converting the input image based on the reference tone curve; and a display panel configured to display the output image.

15. The display apparatus of claim 14, wherein the timing controller is configured to:

obtain color space information from the input image, obtain a first peak luminance, a second peak luminance, and an average luminance from the input image, obtain a first value corresponding to the first peak luminance in the input image, a second value corresponding to the second peak luminance in the input image, and a third value corresponding to the average luminance in the input image, and determine to utilize the HDR function for the input image when a difference between the first and second peak luminances is greater than a reference luminance, when both a difference between the first and third values and a difference between the second and third values are greater than a first reference value, and when the third value is less than a second reference value.

16. The display apparatus of claim 14, wherein the timing controller is configured to:

set the image output mode to a first standard dynamic range (SDR) output mode when it is determined not to utilize the HDR function for the input image, and set the image output mode to a first HDR output mode when it is determined to utilize the HDR function for the input image.

17. The display apparatus of claim 14, wherein the timing controller is configured to:

generate a cumulative luminance histogram by accumulating an input luminance histogram of the input image, determine a reference tone curve parameter based on the first image information, and generate the reference tone curve by adjusting the cumulative luminance histogram based on the reference tone curve parameter.

18. The display apparatus of claim 14, wherein the timing controller is configured to generate an output luminance histogram of the output image by mapping an input luminance histogram of the input image based on the reference tone curve, and wherein the timing controller is configured to generate the output luminance histogram by further performing an inverse tone mapping on the input luminance histogram when it is determined to utilize the HDR function for the input image.

19. The display apparatus of claim 14, wherein the timing controller is configured to further perform a temporal filtering on the output image by inserting at least one buffer frame image between a current frame image and a previous frame image, and wherein the current frame image corresponds to the output image, and the previous frame image corresponds to an image being processed prior to the output image.

20. The display apparatus of claim 14, wherein timing controller is configured to match a measured tone curve of the output image to the reference tone curve after the output image is generated by applying the HDR function to the input image, the measured tone curve being obtained by measuring luminance of the output image displayed on the display panel.

* * * * *